US011498067B2

(12) United States Patent
Sun et al.

(10) Patent No.: US 11,498,067 B2
(45) Date of Patent: Nov. 15, 2022

(54) APPARATUS AND A METHOD FOR PATTERNING BIOLOGICAL CELLS

(71) Applicant: City University of Hong Kong, Kowloon (HK)

(72) Inventors: Dong Sun, Kowloon (HK); Lei Fan, Kowloon (HK); Tao Luo, Kowloon (HK)

(73) Assignee: City University of Hong Kong, Kowloon (HK)

( * ) Notice: Subject to any disclaimer, the term of this patent is extended or adjusted under 35 U.S.C. 154(b) by 157 days.

(21) Appl. No.: 17/143,333

(22) Filed: Jan. 7, 2021

(65) Prior Publication Data

US 2022/0126289 A1 Apr. 28, 2022

Related U.S. Application Data

(60) Provisional application No. 63/104,829, filed on Oct. 23, 2020.

(51) Int. Cl.
*B01L 3/00* (2006.01)

(52) U.S. Cl.
CPC ... *B01L 3/502707* (2013.01); *B01L 3/502738* (2013.01); *B01L 3/502761* (2013.01);
(Continued)

(58) Field of Classification Search
CPC ..... B01L 3/502707; B01L 3/502738; B01L 3/502761; B01L 2200/0647;
(Continued)

(56) References Cited

U.S. PATENT DOCUMENTS 6,864,065 B2 3/2005 Kim et al.
8,759,100 B2 6/2014 Yokoyama et al.
(Continued)

FOREIGN PATENT DOCUMENTS

CN 101177673 5/2010
CN 102382765 10/2013
(Continued)

OTHER PUBLICATIONS

A rapid co-culture stamping device for studying intercellular communication; A. Barforoushi et al.; https://www nature.com/scientificreports; Oct. 18, 2016.
(Continued)

*Primary Examiner* — Jennifer Wecker
*Assistant Examiner* — Oyeleye Alexander Alabi
(74) *Attorney, Agent, or Firm* — Renner, Kenner, Greive, Bobak, Taylor & Weber

(57) ABSTRACT

An apparatus for patterning biological cells, and a method of patterning and coculturing biological cells using the apparatus. The apparatus includes a fluidic structure having an outlet and a plurality of inlets, the fluidic structure is arranged to facilitate a flow of a plurality of different cells in a cell suspension therethrough, wherein each of the plurality of inlets is arranged to facilitate a loading of the plurality of different cells from a plurality of supplies into the fluidic structure; and a flow controlling device arranged to control the flow of the plurality of different cells through the fluidic structure and/or the loading of the plurality of different cells from the plurality of supplies through the plurality of inlets; wherein the fluidic structure is further arranged to facilitate a simultaneous observation of the plurality of different cells arranged in a predetermined pattern in the fluidic structure.

25 Claims, 17 Drawing Sheets

(52) U.S. Cl.
CPC ..... *B01L 2200/0647* (2013.01); *B01L 2300/0816* (2013.01); *B01L 2300/0861* (2013.01); *B01L 2400/0487* (2013.01); *B01L 2400/0655* (2013.01); *B01L 2400/084* (2013.01)

(58) Field of Classification Search
CPC ..... B01L 2300/0816; B01L 2300/0861; B01L 2400/0487; B01L 2400/0655; B01L 2400/084; B01L 2300/0867; B01L 2300/0883; B01L 2400/049; B01L 3/502715
See application file for complete search history.

(56) References Cited

U.S. PATENT DOCUMENTS

| | | | | |
|---|---|---|---|---|
| 2001/0023073 | A1 | 9/2001 | Bhatia et al. | |
| 2002/0182633 | A1 | 12/2002 | Chen et al. | |
| 2011/0189719 | A1 | 8/2011 | Kuo et al. | |
| 2012/0309647 | A1 | 12/2012 | Collins et al. | |
| 2014/0099695 | A1 | 4/2014 | Furuta et al. | |
| 2016/0025761 | A1* | 1/2016 | West | C12M 29/04 435/395 |
| 2016/0272934 | A1* | 9/2016 | Chander | C12M 47/04 |
| 2021/0299657 | A1* | 9/2021 | Lin | G01N 33/54366 |

FOREIGN PATENT DOCUMENTS

| | | |
|---|---|---|
| WO | 2010040804 | 4/2010 |
| WO | 2017116608 | 7/2017 |

OTHER PUBLICATIONS

High throughput and multiplex localization of proteins and cells for in situ micropatterning using pneumatic microfluidics; J. Wang et al;Analyst, 2015, 140, 827; Nov. 18, 2014DOI: 10.1039/c4an01972e www.rsc.org/analyst.

Liver-cell patterning Lab Chip: mimicking the morphology of liver lobule tissue; R. Lin et al;:Lab Chip, 2013, 13, 3578; May 1, 2013.

Massively parallel manipulation of single cells and microparticles using optical images; P. Chiou et al; Nature; vol. 436| Jul. 21, 2005|doi:10.1038/nature03831.

Standing surface acoustic wave based cell coculture; F. Guo el at; dx.doi.org/10.1021/ac502453z | Anal. Chem; Sep. 6, 2014.

Yu-suke Torisawa, et al, Microfluidic platform for chemotaxis in gradients formed by CXCL12 source-sink cells, Integrative Biology, vol. 2, Issue 11-12, Nov. 2010, pp. 680-686, https://doi.org/10.1039/c0ib00041h.

Patterning cells and their environments using multiple laminar fluid flows in capillary networks; S. Takayama et al: Proc. Natl. Acad. Sci. USA; vol. 96, pp. 5545-5548, May 1999; Cell Biology, Applied Physical Sciences.

* cited by examiner

APPARATUS AND A METHOD FOR PATTERNING BIOLOGICAL CELLS

TECHNICAL FIELD

The present invention relates to an apparatus for patterning biological cells, in particular, but not exclusively, to an apparatus that can arrange the biological cells in a predetermined pattern for coculturing. The present invention also relates to a method of patterning and coculturing the biological cells using the apparatus.

BACKGROUND

Biological cells are the basic structural, functional units for all organisms. In other words, cells may be regarded as the building blocks of life. Cell communication, particularly the communication between different cell types, is important for cell regulation and for cells to process information from the environment and respond accordingly. Thus, studies on cell-cell interactions may be important in many biological and medical applications such as drug screening.

In general, the studies of cell-cell interaction may be done by in vitro cell coculture. Cell coculture is a cultivation setup involving randomly mixing two or more cell types on a Petri-dish and allowing the cells to grow thereon. The cell-cell interactions may be observed through a spontaneous cell rearrangement as a result of the differences in intercellular adhesiveness among the different cell types.

SUMMARY OF THE INVENTION

In accordance with the first aspect of the present invention, there is provided an apparatus for patterning biological cells, comprising: a fluidic structure having an outlet and a plurality of inlets, the fluidic structure is arranged to facilitate a flow of a plurality of different cells in a cell suspension therethrough, wherein each of the plurality of inlets is arranged to facilitate a loading of the plurality of different cells from a plurality of supplies into the fluidic structure; a flow controlling device arranged to control the flow of the plurality of different cells through the fluidic structure and/or the loading of the plurality of different cells from the plurality of supplies through the plurality of inlets; wherein the fluidic structure is further arranged to facilitate a simultaneous observation of the plurality of different cells arranged in a predetermined pattern in the fluidic structure.

In an embodiment of the first aspect, the predetermined pattern includes a laminar flow pattern of the plurality of different cells.

In an embodiment of the first aspect, each of the plurality of different cells are visually separable from each other.

In an embodiment of the first aspect, the flow controlling device is arranged to provide a negative pressure to the fluidic structure so as to drive the plurality of different cells to flow through the fluidic structure and/or to control the loading of the plurality of different cells from the plurality of supplies through the plurality of inlets.

In an embodiment of the first aspect, the flow controlling device includes a negative pressure pump arranged to connect to the outlet of the fluidic structure, and arranged to draw air therefrom.

In an embodiment of the first aspect, the negative pressure pump connects to a syringe that is in fluidic communication with the outlet of the fluidic structure, and wherein the syringe is arranged to provide a reference for flow rate of the plurality of different cells flowing through the fluidic structure.

In an embodiment of the first aspect, the outlet is configured in a serpentine shape arranged to further facilitate the control of the flow of the plurality of different cells.

In an embodiment of the first aspect, each of the plurality of supplies includes a single type of cells or a mixture types of cells.

In an embodiment of the first aspect, the fluid structure includes a fluidic channel arranged to facilitate the plurality of different cells in the cell suspension to be arranged in the predetermined pattern.

In an embodiment of the first aspect, the fluidic channel is further arranged to facilitate coculturing of the plurality of different cells in the cell suspension.

In an embodiment of the first aspect, the fluidic channel includes a first region defined by the plurality of inlets, and wherein the first region is arranged to facilitate the plurality of different cells to flow along a laminar flow trajectory.

In an embodiment of the first aspect, each of the plurality of inlets includes a tubular structure in fluidic communication thereto, and wherein the tubular structure is arranged to direct the plurality of different cells to enter into the first region at an angle with respect to a longitudinal axis of the first region.

In an embodiment of the first aspect, the tubular structure is further arranged to facilitate sedimentation of the plurality of different cells across a predetermined length of the tubular structure, such that the plurality of different cells are arranged to form a focused cell stream along the tubular structure.

In an embodiment of the first aspect, the apparatus further comprises at least one gradient generator in fluidic communication with the fluidic channel, wherein the gradient generator is arranged to facilitate a concentration gradient of the cells across a predetermined length of the fluidic channel.

In an embodiment of the first aspect, the at least one gradient generator is perpendicular to the fluidic channel.

In an embodiment of the first aspect, the gradient generator includes a dilution network of microfluidic channels configured in tree-shaped.

In an embodiment of the first aspect, the gradient generator further includes a pair of inlets and a plurality of quadruple mixing outlets in fluidic communication with the fluidic channel of the fluidic structure.

In an embodiment of the first aspect, the fluidic channel is coated with fibronectin.

In an embodiment of the first aspect, the fluidic structure includes a polydimethylsiloxane (PDMS) microfluidic chip.

In an embodiment of the first aspect, the polydimethylsiloxane microfluidic chip is deposited on a glass substrate.

In an embodiment of the first aspect, the apparatus further comprises an observation system arranged to record the plurality of different cells in the fluidic structure.

In an embodiment of the first aspect, the tubular structure includes a polyethylene tubing.

In accordance with a second aspect of the present invention, there is provided a method of patterning and coculturing biological cells, comprising the steps of: loading the fluidic structure of the apparatus in accordance with the first aspect of the present invention with the plurality of different cells in the cell suspension, by connecting the plurality of supplies to the plurality of inlets; manipulating a pressure at the outlet of the fluidic structure so as to control the flow of the plurality of different cells along the fluidic structure; and suspending the flow of the plurality of different cells so as to initiate cell coculturing thereof within the fluidic structure.

In an embodiment of the second aspect, the method further comprises the steps of: incubating the plurality of different cells within the fluidic structure under a predetermined condition; supplying the plurality of different cells within the fluidic structure with a cell medium solution of different concentrations through the gradient generator, so as to generate a cell concentration gradient across a predetermined length of the fluidic structure.

In an embodiment of the second aspect, the cell medium solution is supplied at a flow rate of 0.25 μL/min.

In an embodiment of the second aspect, the method further comprises the step of: purging the fluidic structure to remove air bubbles therein.

BRIEF DESCRIPTION OF THE DRAWINGS

Notwithstanding any other forms which may fall within the scope of the present disclosure, a preferred embodiment will now be described, by way of example only, with reference to the accompanying drawings in which.

DETAILED DESCRIPTION OF THE PREFERRED EMBODIMENTS

Figure 1:
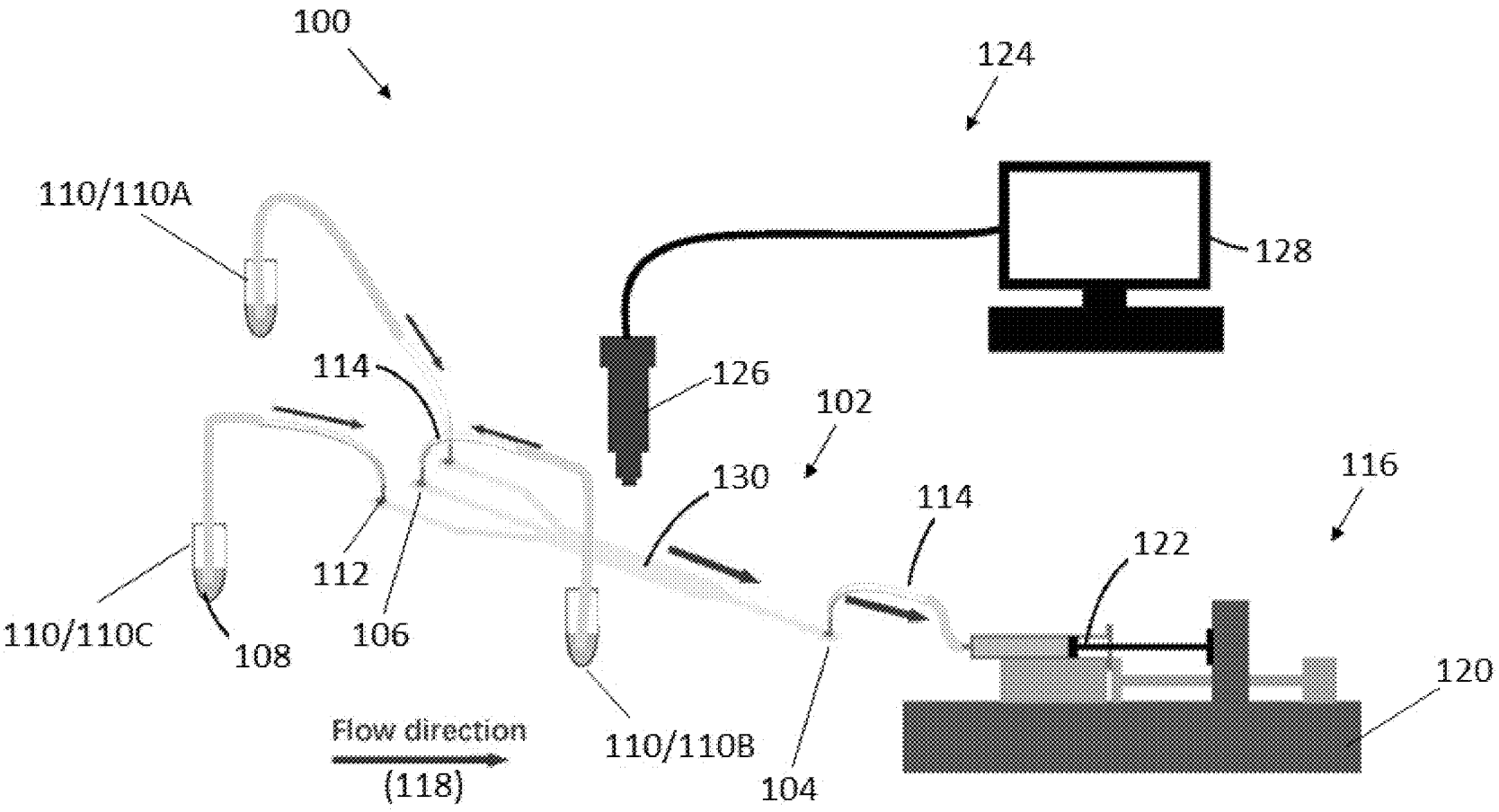
FIG. 1 is a schematic illustration of an apparatus in accordance with an embodiment of the present invention.

In-vitro cell culture is crucial for various biological and medical applications, such as drug screening and cell-cell interaction. In particular, the studies of cell-cell interactions may be done by cell coculture. Traditional cell coculture strategies may exert limited control on the final cell pattern. The inventors have, through their own researches, trials, and experiments, devised that whilst there are various reported engineering approaches for providing a more organized patterning coculture (as compared with the traditional one), those approaches may require excessively complex device fabrication and operation, or entail several cycles of cell loading and washing for patterning coculture of multiple cell types.

In addition, some of the approaches may lack compatibility between the fabrication process of devices as those approaches may be based on micropatterned surfaces and assembly substrates which are difficult to couple with microfluidic chips; whereas some may rely on cumbersome peripheral systems and designs for active multi-channel control of sheath flow so as to pattern multiple cell types. Furthermore, some approaches may require the use of specific fields (e.g. electric field) and/or non-biocompatible buffer, and may be highly sensitive to cell size upon patterning.

Accordingly, it may be preferable to have an apparatus, particularly a microfluidic apparatus that may offer a simple and flexible platform for simultaneously patterning and/or coculturing multiple cell types in vitro.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are considered to be expressly stated in this application in a similar manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

As used herein the term 'and/or' means 'and' or 'or', or where the context allows both.

The invention consists in the foregoing and also envisages constructions of which the following gives examples only. In the following description like numbers denote like features.

As used herein "(s)" following a noun means the plural and/or singular forms of the noun.

In the following description, specific details are given to provide a thorough understanding of the embodiments. However, it will be understood by one of ordinary skill in the art that the embodiments may be practiced without these specific details. For example, software modules, functions, circuits, etc., may be shown in block diagrams in order not to obscure the embodiments in unnecessary detail. In other instances, well-known modules, structures and techniques may not be shown in detail in order not to obscure the embodiments.

Also, it is noted that at least some embodiments may be described as a method (i.e. process) that is depicted as a flowchart, a flow diagram, a structure diagram, or a block diagram. Although a flowchart may describe the operations as a sequential method, many of the operations can be performed in parallel or concurrently. In addition, the order of the operations may be rearranged. A method (i.e. process) is terminated when its operations are completed.

In this specification, the word "comprising" and its variations, such as "comprises", has its usual meaning in accordance with International patent practice. That is, the word does not preclude additional or unrecited elements, substances or method steps, in addition to those specifically recited. Thus, the described apparatus, substance or method may have other elements, substances or steps in various embodiments. The term "comprising" (and its grammatical variations) as used herein are used in the inclusive sense of "having" or "including" and not in the sense of "consisting only of".

With reference to FIG. 1, there is provided an apparatus 100 for patterning biological cells in accordance with one embodiment of the present invention. The apparatus 100 may be capable of patterning and/or coculturing multiple cell types with adjustable spatial arrangement within the apparatus in a one-step manner.

The apparatus 100 may comprise a fluidic structure 102 having an outlet 104 and a plurality of inlets 106, arranged to facilitate a flow of a plurality of different cells 108 in a cell suspension through the fluidic structure 102. Each of the plurality of inlets 106 is arranged to facilitate a loading of the plurality of different cells 108 from a plurality of supplies 110 into the fluidic structure 102.

The fluidic structure 102 may be of any form that is arranged to facilitate the flow of the plurality of different cells 108 therethrough. In one example, the fluidic structure may be implemented as an isolated chip such as a polydimethylsiloxane (PDMS) microfluidic chip. In another example, the fluidic structure 102 may be deposited on a substrate for mechanical support, such as by depositing the fluidic structure 102 on a glass substrate. In yet another example, the fluidic structure may be enclosed within a housing, with each of the inlets 106 and outlet 104 of the fluidic structure 102 being configured with a connector 112 for receiving the plurality of different cells 108 from the supplies 110 or for escaping from the fluidic structure 102, such that the fluidic structure 102 may have a better protection from the external environment during operation.

Each of the plurality of inlets 106 may include a tubular structure 114 in fluidic communication thereto. In particular, the tubular structure 114 may be arranged to direct the plurality of different cells 108 to enter the fluidic structure 102 at a predetermined angle such that the plurality of different cells 108 may be subsequently arranged in a predetermined pattern within the fluidic structure 102. In one example, each of the tubular structures 114 may direct a single type of different cells from each of the supplies 110 into the fluidic structure 102. In another example, each of the tubular structures 114 may direct a mixture types of cell from each of the supplies 110 into the fluidic structure 102. Details of cell patterning will be discussed in the later part of the disclosure.

The fluidic structure 102 may also include a flow controlling device 116 arranged to control the flow of the plurality of different cells 108 through the fluidic structure 102 and/or the loading of the plurality of different cells 108 from the plurality of supplies 110 through the plurality of inlets 106. The flow controlling device 116 may be of any means that can provide a negative pressure to the fluidic structure 102 so as to drive the plurality of different cells 108 to flow through the fluidic structure 102, such as in accordance with the flow direction 118, and/or to control the loading of the plurality of different cells 108 from the plurality of supplies 110 through the plurality of inlets 106.

In one example, the flow controlling device 116 may include a negative pressure pump 120 arranged to connect to the outlet 114 of the fluidic structure 102 and draw air therefrom. As such, the plurality of different cells 108 in the supplies 110 may be drawn as a result of the negative pressure built within the fluidic structure 102, and loaded into the fluidic structure 102, flow along the fluidic structure 102 toward the outlet 104. Preferably, the negative pressure pump 120 may connect to a referencing device 122 arranged to provide a reference of flow rate of the plurality of different cells 108 flowing through the fluidic structure 102. In one example, the negative pressure pump 120 may connect to a syringe 122 that is in fluidic communication with the outlet 104 of the fluidic structure 102. The syringe 122 is arranged to provide a reference of flow rate of the plurality of different cells 108 flowing through the fluidic structure via the markings on the syringe 122.

In particular, the fluidic structure 102 may be further arranged to facilitate a simultaneous observation of the plurality of different cells 108 arranged in a predetermined pattern in the fluidic structure 102. Preferably, the plurality of different cells 108 may be arranged in a laminar flow pattern and each of the plurality of different cells 108 are visually separable from each other. In one example, three different single cell types may be arranged/organized in parallel to each other, in their respective line pattern, and each of the line patterns may be visually separable from each other by any coloring means such as visible organic dyes, fluorescent dyes and the like, or by organizing physical gap(s) between the adjacent line patterns. In an alternative example, each of the line patterns may include a mixture of cell types, and may be visually separable from each other by the coloring means and/or physical gap(s).

The apparatus 100 may further comprise an observation system 124 arranged to record the plurality of different cells 108 in the fluidic structure 102. For example, the apparatus 100 may include a microscope equipped with a CCD camera 126 known in the art, such as a digital microscope, a fluorescence microscope and the like, for recording the real-time situation of the plurality of different cells 108, such as their flow, pattern, and/or culturing condition, and displaying the results on a display such as a computer display 128.

Referring to FIG. 1, the apparatus 100 comprises a fluidic structure 102 with an outlet 104 and three or five inlets 106. It is appreciated that the number of inlets discussed herein is merely exemplary, a skilled person may vary the number of inlets according to his/her requirement for the number cell samples to be introduced and patterned.

Each of the inlets 106 and the outlet 104 is provided with a connector 112 configured vertically with respect to the longitudinal axis (not shown) of the fluidic structure 102, arranged to facilitate the connection of a plurality of supplies 110 to the inlets 106 and the connection of a flow controlling device 116 to the outlet 104.

In this example, there is provided with three supplies 110 and each of them contains a cell suspension having a plurality of different cells 108. Each of the cell suspensions may include a single type of cell and each type of cell is different from each other. For example, the upper supply 110A may include HeLa cells, the middle supply 110B may include NB-4 cells, and the bottom supply 110C may include yeast cells. Alternatively, each of the supplies 110 may contain a mixture types of cells, and each mixture may be identical or may be different from each other.

Each of the supplies 110 is connected to the inlets 106 via their respective tubular structure 114. The tubular structure 114 may be made of any flexible material that is arranged to be easily modified with the length and/or shape thereof. In this example, the tubular structures 114 may be made of polyethylene.

At the outlet side, there is provided with a flow controlling device 116 comprising a syringe pump 120 with a syringe 122 operably connected thereon. The syringe 122 is fluidically connected to the outlet 104 via the connector 112 through the polyethylene tubing 114. The syringe 122 is provided with markings such that when the syringe pump 120 applies a negative pressure to the fluidic structure 102 to draw air and/or suspension fluid from the supplies 110, the syringe head will move with respect to the markings and therefore providing a reference to the user whether the flow rate of the plurality of different cells 108 is optimum or not.

The apparatus 100 is also provided with an observation system 124, which includes a fluorescence microscope with a CCD camera 126 operably connected to a computer display 128. With the use of the observation system 124, the status of cell, such as patterning and/or coculturing, may be recorded and displayed on the computer display 128.

As shown in FIG. 1, each of the tubular structures 114 may be configured with a predetermined length. The inventors have, through their own researches, trials, and experiments, devised that such configuration may facilitate sedimentation of the cells 108 across the predetermined length of the tubular structure 114, such that the cells 108 may form a focused cell stream along the tubular structure 114. As such, the cells 108 may be more easily directed into the fluidic structure 102 at a particular angle, thereby facilitating the subsequent patterning process of the cells 108 within the fluidic structure 102.

Figure 2:
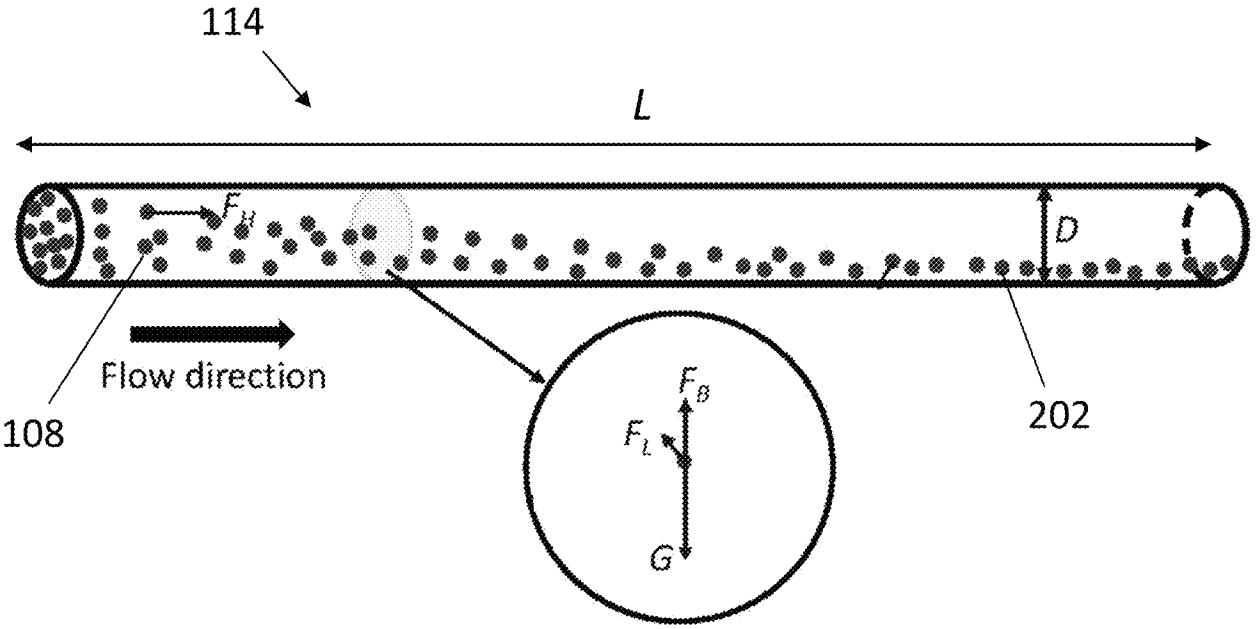
FIG. 2 illustrates the gravitational sedimentation process and force analysis of flowing cells in a tubular structure with a diameter D and a length L.

With reference to FIGS. 2 and 3, the tubular structure 114 may have a diameter D such as 0.38 mm and a predetermined length of L. When the flow controlling device 116 applies a negative pressure to the fluidic structure 102, the plurality of different cells 108 in the cell suspension will flow along the tubular structure 114. The motion/trajectory of the cells 108 may be affected by buoyant force $F_B$, gravity G, net inertial force $F_L$, and hydrodynamic drag force $F_H$. In particular, $F_B$, G, and $F_L$ may affect the lateral motion of the cells 108 in the cross-section of tubular structure 114, whereas $F_H$ may drive the cells 108 to move forward along the axial direction of the tubular structure 114. As a result of low Reynolds number (Re) of the present invention, $F_L$ may be disregarded. Thus, the lateral motion of the cells 108 may be dominated by the net force of G and $F_B$.

Figure 3A:
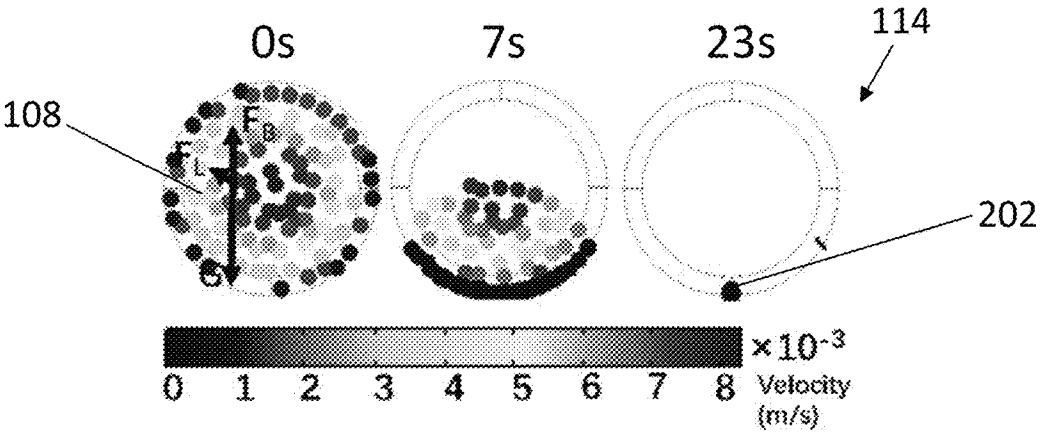
FIG. 3A illustrates the stimulation results of the gravitational sedimentation process over 23 seconds.
Figure 3B:
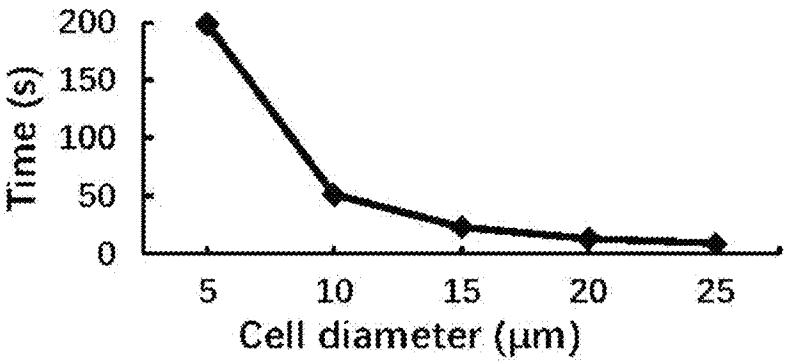
FIG. 3B is a plot of time against cell diameter illustrating the relationship between the minimum time to complete cell sedimentation and the cell diameter.

As shown in FIGS. 2 and 3A, as the cells 108 move along the tubular structure 114, and the cells 108 gradually sediment and aggregate to the bottom of the tubular structure 114, forming a focused cell steam 202 across the length of the tubular structure 114. As shown in FIG. 3B, the complete sedimentation time and diameter of cells is generally in a negative relationship. That is, the larger the size of the cells, the less time the cells required to sediment to the bottom of the tubular structure 114. In view of the plot as shown in FIG. 3B, the inventors have further devised that the minimum length of the tubular structure 114 for complete sedimentation of a particular cell type may be calculated by multiplying the sedimentation time with the average flow velocity. Thus, the user may apply the above calculation to use a tubular structure with a proper length for operation. By using a tubular structure with a sufficient length, cells with diverse sizes may be reliably sediment to the bottom part of the tubular structure. As such, it is advantageous that cells with a wide range of cell size may be patterned and/or cocultured by the present invention.

Referring back to FIG. 1, as shown, each of the tubular structures 114 is further configured to point toward a predetermined direction such that the sedimented cells 202 in the tubular structure 114 may enter into the fluidic structure 102 at a particular angle for patterning. In particular, the fluidic structure 102 may include a fluidic channel 130 arranged to facilitate the entered cells 202 to be arranged in a laminar flow pattern.

Referring to FIGS. 4 and 5, the fluidic channel 130 may include a first region 402 defined by the plurality of inlets 106 and a second region 404 in fluidic communication in between the first region 402 and the outlet 104. Each of the first regions 402 may be fludicially connect with the tubular structures 114 so as to receive a focused cell stream 202 therefrom. In other words, the first region 402 may be regarded as a cell focusing region, which "gathers" the focused cell stream 202 from the tubular structure 114 at this region. The cells 202 entered the cell focusing region 402 may then flow toward the second region 404 at which the cells 202 are patterned and/or cocultured with the application of negative pressure at the outlet 104 by the flow controlling device 116. In other words, the second region 404 may be regarded as a cell patterning/coculturing region.

Figure 4A:
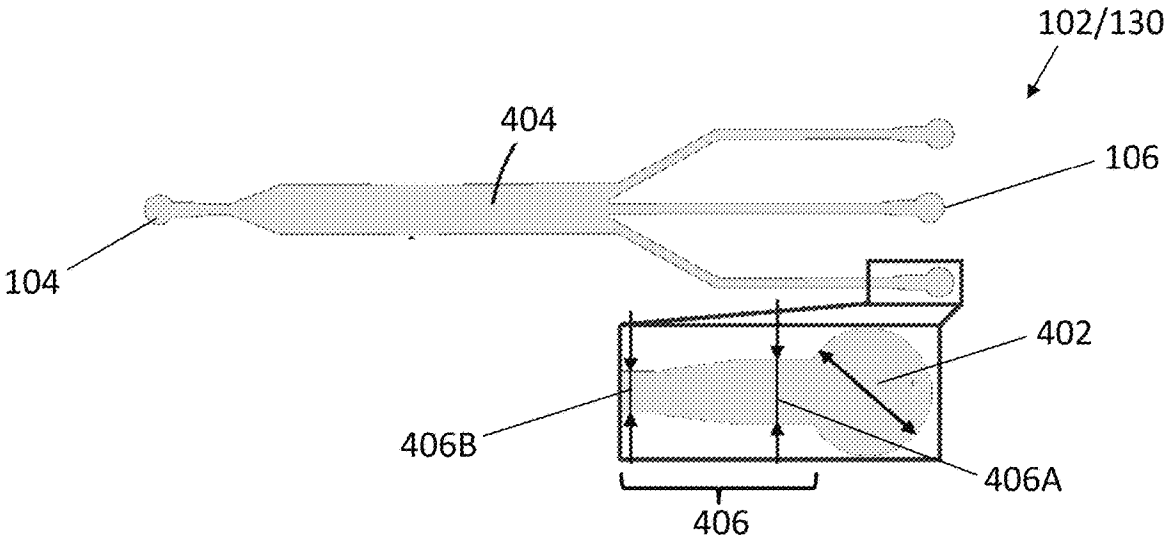
FIG. 4A is a schematic illustration of a fluidic structure of the apparatus of FIG. 1 in accordance with one example embodiment.
Figure 4B:
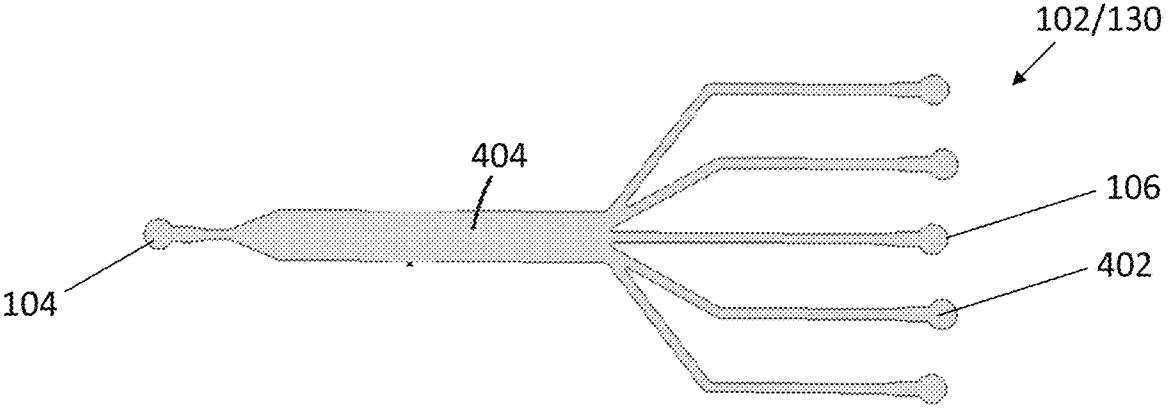
FIG. 4B is a schematic illustration of a fluidic structure of the apparatus of FIG. 1 in accordance with another example embodiment.

As shown in FIGS. 4A and 4B, the fluidic channel 130 may have three or five cell focusing regions 402 defined by the inlets 106 and a cell patterning/coculturing region 404.

It is appreciated that the design of multiple inlets (and therefore the multiple cell focusing regions) is advantageous in reducing the operation setup for each of the different cell types as they can be loaded and patterned simultaneously in the present invention.

Each of the cell focusing regions 402 is in fluidic communication with an inlet channel 406. In this example, the cell focusing region 402 is of circular shape and may have a diameter of 1.2 mm, and the cell focusing region 402 is connected to an inlet channel 406 having two segments of different widths, with the one closer to the cell focusing region to be wider than the distant one. For example, the closer segment 406A may have a width of 0.6 mm whereas the distant segment 406B may have a width of 0.4 mm. The inlet channels 406 are further fluidicially connected to the cell patterning/coculturing region 404, which may have a width of 2 mm.

Figure 5A:
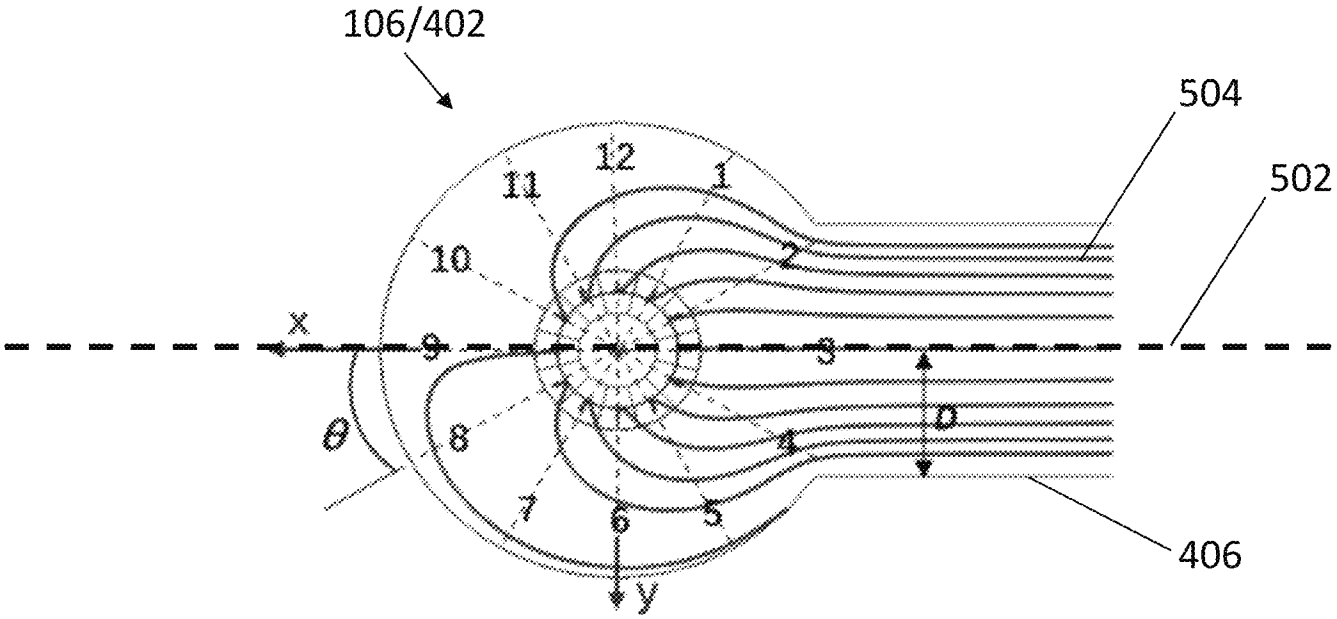
FIG. 5A is an illustration showing the stimulated distribution of laminar streamlines in the fluidic channel of the fluidic structure.
Figure 5B:
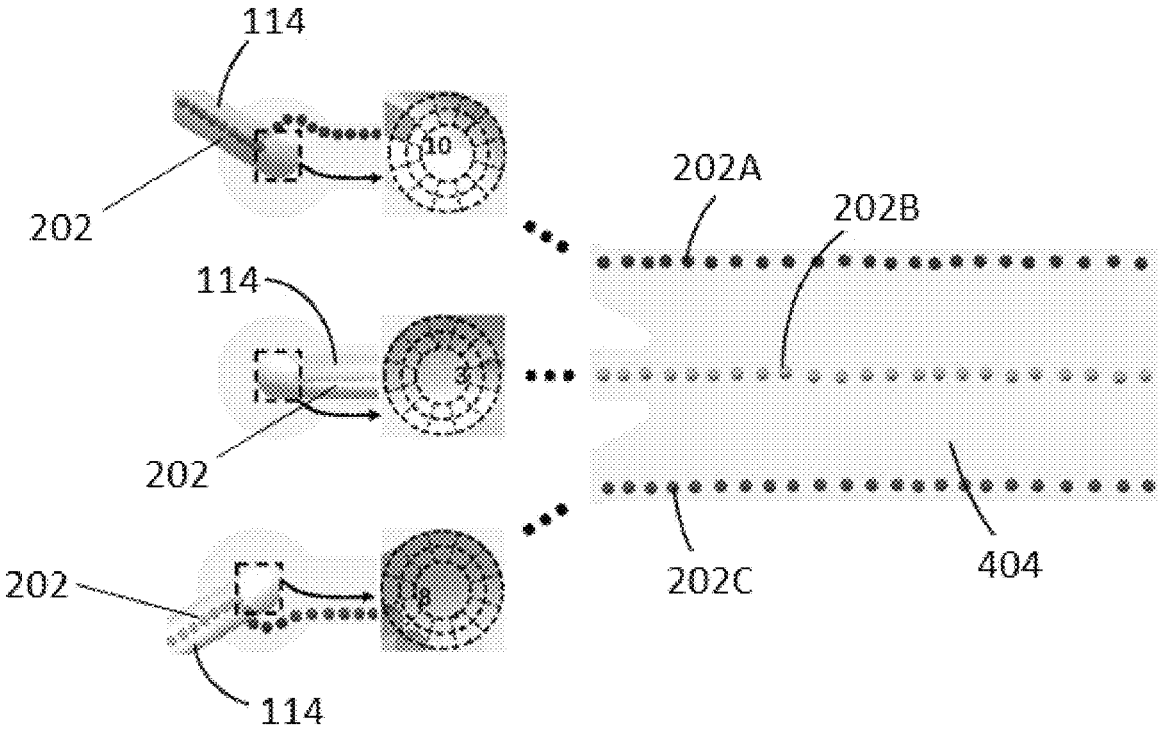
FIG. 5B is a schematic representation showing the tubing steering angle that the cells enter the fluidic channel and the corresponding resultant position of the cells.

The inventors have devised that each of the cell focusing regions 402 may be considered as a concentric circle having 12 sectors, and the direction of these 12 sectors may be considered as matching a "clock time". An angle θ with respect to a longitudinal axis 502 of the cell focusing region may be considered as representing the direction of the tubular structure 114 (FIG. 5A). As shown in FIGS. 5A and 5B, each of the sectors may have its own laminar flow trajectory 504 originating from the centre of cell focusing region 402, and each of the trajectories 504 is in parallel to each other and to the sidewalls of the inlet channels 406. When the sedimented cells 202 enter into the cell focusing region 402 from one tubular structure 114 at an angle θ defined by the direction of the tubular structure 114, the cells 202 are then consequently directed to enter the corresponding sector of the cell focusing region 402, and flow along the laminar flow trajectory 504 represented by that sector.

For example, as shown in FIG. 5B, when the sedimented cells 202 enter from a tubular structure at a 10 o'clock direction (i.e. angle θ=330°), the cells 202A will flow along the laminar flow trajectory represented by that direction/sector, forming a cell strip 202A along the upper part of the cell patterning/coculturing region 404. Similarly, when the sedimented cells 202 enter the cell focusing region 402 from a tubular structure 114 at a 3 o'clock direction and 8 o'clock direction (i.e. angle θ=180° and 30°, respectively), the cells 202 will flow along the laminar flow trajectories represented by those directions/sectors, forming a cell strip along the middle part (202B) and lower part (202C) of the cell patterning/coculturing region 404, respectively. Accordingly, a cell pattern of multiple cell types is obtained.

Figure 5C:
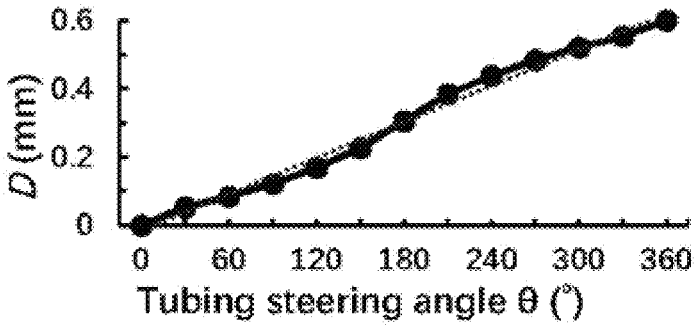
FIG. 5C is a plot of distance D against tubing steering angle showing the relationship between resultant position of the cells and the tubing steering angles.

In addition, by varying the direction of the tubular structure 114, or in other words, by steering the tubular structure 114 at different angle θ, the position of the cell strip may be altered accordingly. As shown in FIGS. 5A and 5C, as the angle θ increases from 0° to 360°, the distance D between the lower sidewall of the cell patterning/coculturing region 404 and each of the laminar flow trajectories 504 increases substantially proportionately. Thus, by simply changing the angle/direction of the tubular structure 114, each of the cell strips may be moved from the lower part to the upper part of the cell patterning/coculturing region 404. In one example, the distance between three adjacent cell strips may be adjusted from 0 to 1.34 mm. In another example, the distance between five adjacent cell strips may be adjusted from 0 to 0.084 mm. Accordingly, it is appreciated that the cell pattern may be flexibly adjusted in real time, without the need of redesigning the fluidic channel 402 of the fluidic structure 102.

Figure 6:
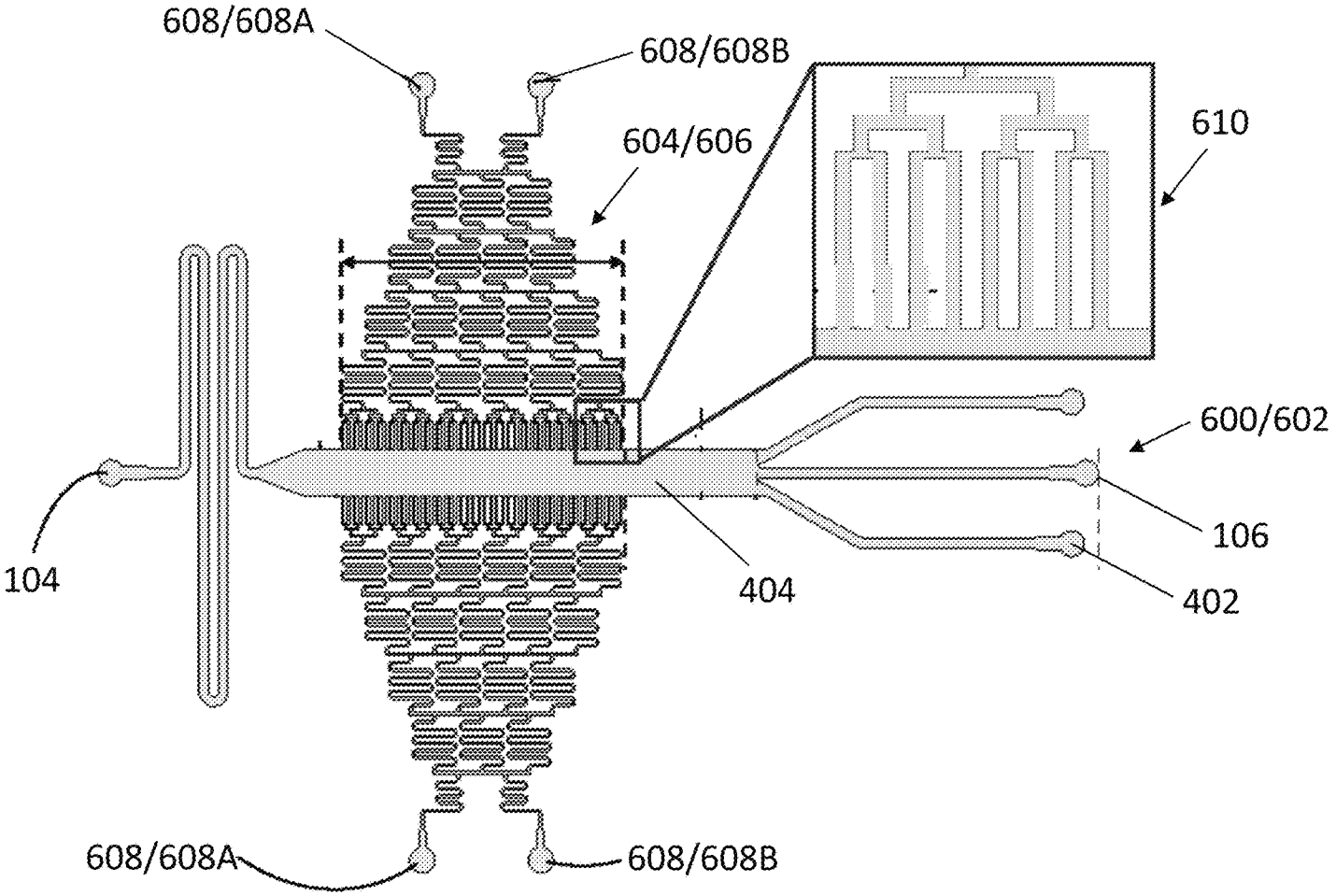
FIG. 6 is a schematic illustration a fluidic structure of the apparatus of FIG. 1 in accordance with yet another example embodiment.

As mentioned above, the apparatus 100 may be further used for coculturing the patterned multiple cell types. With reference to FIG. 6, there is provided with an alternative embodiment of a fluidic structure 600 of the apparatus 100. The fluidic structure 600 may have a fluidic channel 602 arranged to facilitate the plurality of different cells 108 to be arranged in a laminar flow pattern. The fluidic channel 602 may be similar to the fluidic channels 130 as mentioned above, having a plurality of cell focusing regions 402 defined by the plurality of inlets 106, and a cell patterning/coculturing region 404 connecting in between the outlet 104 and the cell focusing region 404. The outlet 104 may be configured in a serpentine shape arranged to facilitate the control of the flow of the plurality of different cells 108. The serpentine-shaped outlet 404 may increase the overall travelling path of the fluidic channel 602 and therefore reducing the flow rate of the plurality of different cells 108 within the fluidic channel 602 under a given negative pressure. In this way, together with the aid of the observation system 124, it may allow the user to have more time to fine tune the pattern of the cells 202 within the cell patterning/coculturing region, by tuning the angle of the tubular structure 114 as mentioned above.

In particular, the fluidic channel 602 may be in fluidic communication with at least one gradient generator 604 arranged to facilitate a concentration gradient of the cells across a predetermined length of the fluidic channel 602. Preferably, the at least one gradient generator 604 may carry different concentrations of cell medium solution and is perpendicular to the fluidic channel 602 such that when the cells flow along the cell patterning/coculturing region 404, the cell medium solution (of different concentrations) may be supplied to the cells 202 from a top down direction of the cell patterning/coculturing region 404 or vice versa (i.e. from the upper edge to the lower edge of the region 404 or vice versa), generating a cell concentration gradient across a length of the gradient generator 604.

Referring to FIG. 6, the gradient generator 404 may have a dilution network of microfluidic channels 606 configured in tree-shaped. The gradient generator 404 may also include a pair of inlets 608 located at the top of the gradient generator 404, and a plurality of quadruple mixing outlets 610 in fluidic communication with the fluidic channel 602 of the fluidic structure 600. Preferably, each of the pair of inlets 608 may be arranged to receive different concentrations of cell medium solution such as the left inlet 608A may receive a high concentration of cell medium solution whereas the right inlet 608B may receive a low concentration of cell medium solution. As such, after passing through the dilution network 606, a cell medium concentration gradient would be generated across the length of the gradient generator 604, with the highest cell medium concentration located at the outlet side and the lowest cell medium concentration located at the inlet side. The cells 202 flowing along the cell patterning/coculturing region 404 may therefore receive a particular concentration of the cell medium solution and grow accordingly, thereby establishing a cell concentration gradient within the cell patterning/coculturing region 404.

As shown in FIG. 6, in this example, the fluidic structure 600 includes a fluidic channel 602 having three cell focusing regions 402 defined by the three inlets 106, and a cell patterning/coculturing region 404 connecting in between the serpentine-shaped outlet 104 and the cell focusing regions 402. In order to facilitate cell adhesion and culturing, at least the cell patterning/coculturing region 404, preferably the whole fluidic channel 602, is coated with fibronectin. The three inlets 106 may be connected with three supplies 110 so as to receive three different, single type of cells 108 or three mixture types of cell 108 from each of the supplies 110 as mentioned above. The outlet 104 may also be connected with a negative pressure pump 120 through a syringe 122, receiving a negative pressure therefrom, to drive the sedimented cells 202 to flow along the fluidic channel 602.

At the cell patterning/coculturing region 404, there are two gradient generators 604, each of which is provided in the opposite side of the cell patterning/coculturing region 404, mirroring with each other. The gradient generators 604 are perpendicular to, and in fluidic communication with cell patterning/coculturing region 404. In this example, the gradient generators 604 may have a length of 11.85 mm. The gradient generators 604 also include a high concentration inlet 608A arranged to receive a high concentration cell medium solution, a low concentration inlet 608B arranged to receive a low concentration cell medium solution, a tree-shaped microfluidic dilution network 606, and a plurality of quadruple mixing outlets 610 with each of which may have a width of 0.1 mm.

In one example, the two pairs of high concentration inlets 608A and low concentration inlets 608B may be supplied with the high and low concentration cell medium solutions simultaneously, such as by using two sets of negative pressure pump to pump the cell medium solutions into the inlets with the same flow rate. As such, a concentration gradient of cell medium solution with six different concentrations (from highest to lowest across the left to the right side of the gradient generators) would be established at both sides of the cell patterning/coculturing region 404 that is in fluidic communication with the quadruple mixing outlets 610.

In another example, only one of the two gradient generators 604 may be operated. That is to say, for example, the cell medium solutions may be supplied to the inlets of the upper gradient generator 604A, and flow out from the inlets of the lower gradient generator 604B, or vice versa. This configuration may be advantageous as "fresh" cell medium solution may keep flowing through the cell patterning/coculturing region 404, which may facilitate the growth of cells therein.

In operation, the user may first connect the plurality of inlets 106 of the fluidic structure 600 with a positive pressure pump via the tubular structures 114, and apply a positive pressure to the fluidic structure 600 so as to purge the fluidic structure 600 to remove any air bubbles therein. After that, the positive pressure pump may be removed. The plurality of inlets 106 may then be connected with the plurality of supplies 110 via the tubular structures 114, and the outlet 104 may be connected with the flow controlling device 116, such as the syringe 122 in connection with the syringe pump 120, through the tubular structure 114.

The user may then start to manipulate a pressure at the outlet 104, such as applying a negative pressure, to load the plurality of different cells 108 into the fluidic structure 600, and control the flow of the cells along the fluidic structure 600. Meanwhile, the inlets 608 of the gradient generators 604 may be blocked when the negative pressure is applied so as to avoid any air bubbles generating within the fluidic structure 600. As mentioned, the user may manipulate the pressure and therefore the flow rate with reference to the marking of the syringe 122.

As mentioned, the direction/steering angle of the tubular structures 114 may be manipulated, such that the user may adjust the laminar flow trajectory 504 of each of the sedimented cells 202 when they enter the fluidic structure 600, thereby establishing different cell patterns according his/her requirement in the cell patterning/coculturing region 404.

Optionally or additionally, the user may further manipulate the direction/steering angle of the tubular structures 114 with reference to the real-time situation provided by the observation system 124 as discussed above, so as to fine tune the cell pattern according to the user's requirement.

When a desired cell pattern is obtained, for example, after 2 min, the user may suspend the flow of the cells by terminating the operation of the flow controlling device 116 so as to initiate coculturing of the cells 202 within the fluidic structure 600. Preferably, the tubular structures 114 may be blocked and the cells 202 within the cell patterning/coculturing region 404 may be incubated under a predetermined condition, such as 12 h, to allow the cells 202 to settle and attach to the region 404. After that, multiple cells with a particular laminar flow pattern is therefore obtained.

By supplying the cells 202 within the cell patterning/coculturing region 404 of the fluidic structure 600 with a cell medium solution of different concentrations through the gradient generator 604, a cell concentration gradient may be generated across the length of the generator 604.

As mentioned, the gradient generator 604 may be supplied with the high concentration and the low concentration cell medium solutions simultaneously by pumping them to the corresponding inlets 608 of the gradient generator 604 with the same flow rate. For example, the high concentration and the low concentration cell medium solutions may be pumped into the corresponding inlets 608 with a flow rate of 0.25 μL/min by connecting the inlets 608 with two separate syringe pumps.

After the cell medium solutions passing through the tree-shaped dilution network 606, a cell medium solution concentration gradient with six different concentrations may be generated along the cell patterning/coculturing region 404 of the fluidic structure 600. By further incubating the cells 202 under such cell medium solution concentration gradient, the cell concentration gradient would be formed accordingly.

The characterization, cell patterning and coculturing performance of the presently claimed apparatus will now be discussed.

In one example experiment, human acute promyelocytic leukemia NB-4 cells were cultured in RPMI 1640 medium (Sigma, St Louis, Mo.) supplemented with 10% FBS (Atlanta Biologicals, GA) and 1% antibiotics/antimycotics (Invitrogen) to characterize the cell patterns induced by the proposed gravitational sedimentation approach. Human umbilical vein endothelial cell line EA.hy926, human cervix cancer cell line Hela labelled with green fluorescence reporter (Hela-GFP), and human dermal fibroblasts neonatal (HDFn) were cultured in DMEM (Invitrogen) supplemented with 10% FBS, 1% antibiotics/antimycotics, 4.5 g/L D-glucose, 2 mM L-glutamine, 110 mg/L sodium pyruvate to characterize Hela-GFP cell migration and growth under the coculture condition. All of the cell lines were cultured in a humidified incubator at 37° C. under 5% $CO_2$ atmosphere. When the cells grew to 80%-90% confluency, Hela-GFP cells were sub-cultured and resuspended in DMEM, NB-4 cells were stained with Hoechst 33342 or CFDA-SE for blue or green fluorescence, respectively, and yeast cells were stained with MitoTracker® Red 580 in accordance with the standard protocols. The cells were washed with PBS, resuspended in a fresh culture medium to the desired densities, and loaded into the microchip through the cell focusing region for the cell patterning experiments.

In this example, the microfluidic chips were fabricated via standardized soft lithography. For example, a silicon wafer with a diameter of 4 inches was used as the substrate and spin coated with a 100 μm thin layer of the negative photoresist SU-8 2050 (Microchem Corp.). After the specimen was prebaked at 65° C. to 95° C., exposed to a low-cost film mask, and developed, the SU-8 mold for PDMS microchannel casting was first obtained. The mixture of PDMS (Sylgard 184, Dow Corning) and the corresponding curing agent at a weight ratio of 10:1 was then poured on the SU-8 mold. The mold with the PDMS mixture was placed in a vacuum oven and baked at 70° C. for 2 h to remove air bubbles and cure the PDMS. The cured PDMS microchannel was punched at the inlets and outlets after peeling off from the SU-8 mold.

The punched PDMS microchannel was bonded with a glass substrate after the specimen was treated with oxygen plasma and baked in an oven at 70° C. A 25 μg/mL fibronectin solution was introduced to the bonded microchannel and incubated at room temperature for approximately 1 h to coat a thin layer on the inner surface of the microchannel to improve cell adhesion and growth. Furthermore, the solution of fibronectin was pumped out by using a vacuum pump to improve coating. The finished microchip could be stored in a fridge at 4° C. not longer than 1 week before each experiment.

The cell patterning coculture procedures are described as follows. Before loading cells into the chip, the bubbles were firstly removed. The cells were fully dispersed by using the pipette to avoid cell clustering. Subsequently, different cell suspensions were aspirated into different inlets of the cell focusing region and patterned in the cell coculture region when negative pressure was supplied at the outlet of main channel by using a syringe pump (LSP01-2A, longer Pump) and the two gradient generators were blocked. After 2 min, the syringe pump operation was terminated, all the tubings were carefully blocked, and the chip was placed in an incubator for 12 h to allow absolute cell settlement and attachment. The patterned cells could be cocultured under the drug gradient after the tubings of two gradient generators were unblocked and the high and low concentration media were injected at the same flow rate of 0.25 μL/min.

Experiments were recorded using an inverted microscope (Eclipse Ts2R-FL, Nikon) with a CCD camera (DigiRetina 16, Tucsen Photonics). The fluorescence of the patterned cells in the chip was analyzed with ImageJ. Flow field distribution, gravitational sedimentation, and gradient generation were simulated with the finite element software COMSOL Multiphysics. A stationary CFD problem was calculated in accordance with the physics of laminar flow to predict the cell trajectories and patterning shapes. In this case, the cell patterns at different tubing steering angles were visualized via streamlines with different colours. A time-dependent cell trajectory problem was solved in accordance with particle tracing physics for fluid flow and laminar flow to characterize the gravitational sedimentation of the cells in the tubing at different flow rates and diameters. The gradient of the drug concentration was generated using the physics of diluted species transport under convection mechanisms.

The patterning coculture of multiple cell types in the same channel may be achieved on a microfluidic chip with multiple inlets. As shown in FIG. 1, a microfluidic chip with three inlets and one outlet are used to pattern and coculture three types of cells. Three types of cells can be simultaneously introduced into the microchannel using syringe pumps to form three cell strips with gaps between adjacent strips for cell proliferation.

In particular, the gap width between adjacent cell strips may be adjusted by manipulating the tubing direction. For example, as shown in FIG. 5B, three cell strips may be patterned along the upper sidewall, central axis, and lower sidewall of the microchannel by applying the tubing directions at 10, 3, and 8 o'clock positions, respectively. With this capability, the position of a cell strip can be flexibly and independently adjusted without redesigning the microfluidic chip or reconfiguring the multi-channel flow control. As a result, different cell patterns can be easily achieved in the same microfluidic chip for various studies, such as short and long distance cell-cell communication. The microfluidic chip of the present invention is also advantageous that it allows the user to load multiple cell types in a one-step manner, and allow the user to load more different cell types simply by scaling up the number of inlets of the microfluidic chip. In this way, it would guarantee that all the cells have the same onset for physiologically relevant studies.

The capability of the present invention to pattern and coculture multiple cell types in the same channel simultaneously may be attributed to the combination of gravitational sedimentation and laminar flow. As shown in FIG. 2, the motion of a cell in the cross-section of the tubing is affected by gravity G, buoyant force $F_B$, and inertial lift force $F_L$.

In view of the flow rates used in this work, the Reynolds number may be considered as small, and the inertial lift force $F_L$ may be disregarded on the basis of the reported calculation. Hence, the net force of G and FB dominates cellular motion in the cross-section of the tubing. Also, cells are usually slightly denser than fluids, such as cell culture media and blood plasmas. Therefore, cells may form a sediment along the direction of gravity in these media.

To investigate the concept of gravitational sedimentation of the cells as mentioned above, a simulated sedimentation process for about 23 s of cells with a diameter of 15 μm in a cross-section of a tubing with a diameter of 0.38 mm (same as the tubing size used in the microfluidic chip) has been performed (FIG. 3A). Water, which has a density similar to that of cell culture media, was used to mimic the cell culture media in the simulations. As shown in FIGS. 3A and 3B, the cells aggregate at the bottom of the tubing upon moving along the tubing, and the relationship between complete sedimentation time and the diameter of cells based on the simulation results illustrating that large cells require less time to complete the sedimentation.

The required minimum tubing length for complete cell sedimentation may be roughly calculated from FIG. 3B, by multiplying the sedimentation time with the average flow velocity. As such, cells with diverse sizes can reliably sediment to the bottom part of the tubing by using sufficient tubing length. Accordingly, the cell patterning process would no longer be confined by the cell size, or in other words, the microfluidic chip of the present invention is applicable in patterning a wide range of cell types of different cell sizes.

The cells finally flow into the microchannel of the microfluidic chip after their sedimentation at the bottom part of the tubing, and the flow pattern of the cells in the microchannel may be attributed to the distribution of laminar flow streamlines. To investigate the relationship between the flow pattern of the cells and the distribution of laminar flow streamlines, a stimulation of streamline distribution of the fluid flow originated from different parts of the inlet has been performed. In this stimulation, each of the inlets have an inner diameter of 0.38 mm, which is the same as the diameter of the tubing as mentioned above.

As shown in FIG. 5A, the external profile and the central structure may be considered as the microchannel and one of the inlets, respectively. In particular, the inlet may be considered to be a concentric circle consisting of 12 sectors. The direction of these 12 sectors matches the "clock time". The tubing steering angle θ between the centre line of each sector and the x-axis represents the tubing direction. As shown, the streamlines originating from each of the sectors have their unique trajectories, which are parallel to the microchannel wall. Therefore, when the sedimented cells from one tubing flow into a particular sector, they are then directed to flow forward along the streamline defined by that particular sector, creating a cell strip parallel to the sidewall.

In operation, the cells may be directed to different sectors, and then flow along different streamlines in the microchannel by applying the tubing at different tubing steering angles. Accordingly, the cell patterns may be flexibly adjusted in real-time basis by simply changing the tubing direction. As shown in FIG. 5C, the cell strip moves from the lower sidewall to the upper sidewall of the microchannel when the tubing steering angle increases from 0° to 360°, which further suggests that the patterned cell strip may be readily adjusted by simply changing the tubing steering angle.

To verify the performance of the gravitational sedimentation-based approach to pattern and coculture multiple cell types, a polydimethylsiloxane (PDMS) microfluidic chip with three inlets and one outlet was designed and fabricated (FIG. 4A). In this example, three types of cell with different sizes were demonstrated to be patterned in the same microfluidic channel simultaneously by one-step loading, the cells used herein were yeast (6 μm), NB-4 (15 μm), and Hela-GFP cells (20 μm).

The yeast and NB-4 cells were stained with Mito Tracker® 580 red fluorescent dye and Hoechst 33342 blue fluorescent dye to improve visualization, respectively. As discussed above, small cells require longer tubing to completely undergo sedimentation at a fixed flow rate. In this case, it is calculated that a minimum tubing length of 293 mm is required for the yeast cells (which is the smallest cell type among the three tested cell types) to completely sediment under a flow rate of 10 μL/min. Accordingly, in this example, the tubing is configured to be 300 mm and it is appreciated that such length is sufficient for all three cell types to complete their sedimentation within the tubing.

Figure 7A:
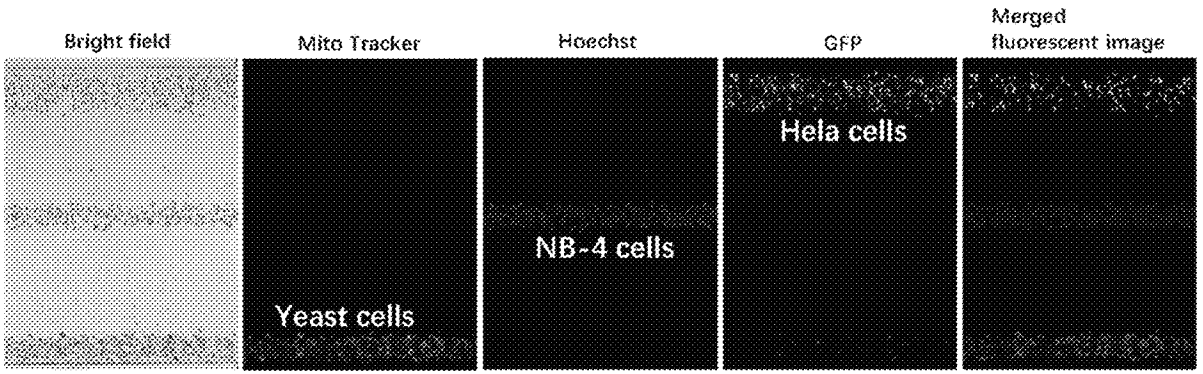
FIG. 7A is a set of microscopic images showing each of the cells with different sizes to be patterned simultaneously in the same fluidic channel.

First, the simultaneous patterning of different cell types on different microchannel positions was demonstrated. The three types of cells were separately suspended in supplemented Dulbecco's modified eagle medium (DMEM) and loaded into the chip through a syringe pump. Hela-GFP cells were introduced to the chip through the tubing inserted in the upper inlet, and the yeast and NB-4 cells were introduced to the chip from the tubings inserted in the lower and middle inlets, respectively. As shown in FIG. 7A, the yeast cells labelled with red fluorescence were focused and patterned at the lower side of microchannel at a tubing steering angle of 30°. At the same time, NB-4 cells were patterned along the central axis of microchannel at a tubing steering angle of 180°, and Hela-GFP cells were patterned at the upper side of the microchannel at tubing steering angle of 330°.

Figure 7B:
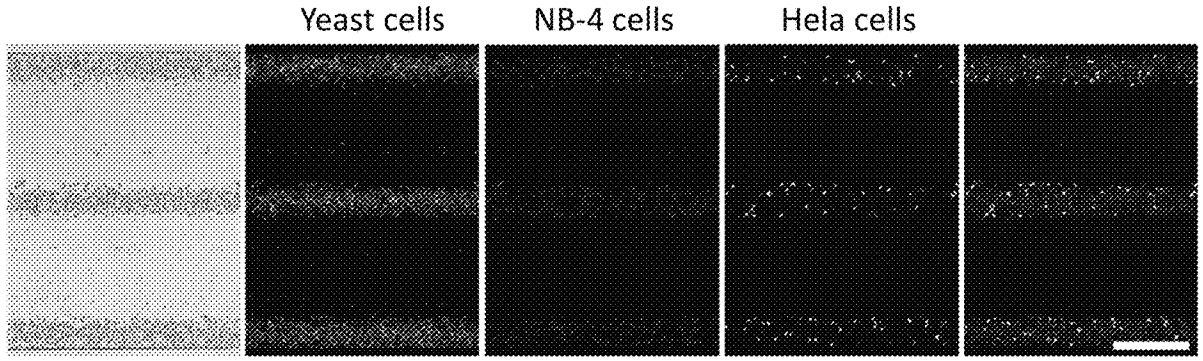
FIG. 7B is a set of microscopic images showing each of the cell mixtures to be patterned simultaneously in the same fluidic channel.

In view of the success above, the simultaneous patterning of different cell types on the same positions of the microchannel was demonstrated. In this example, the three types of cell were uniformly mixed and resuspended in DMEM, the three cell mixtures were loaded into the chip with the same tubing configuration as mentioned in regard to FIG. 7A. As shown in FIG. 7B, the cell mixtures is patterned into three cell strips and all the three cell strips contain the three types of cells. The above results suggest that the patterning of the present invention (i.e. the gravitational sedimentation-based approach) is independent of cell size, and therefore it is particularly advantageous for patterning and coculturing three or more cell types on a microfluidic chip without redesigning the chip structure.

A microfluidic chip with five inlets (FIG. 4B) was further fabricated to pattern different cells under different tubing configurations along with the microfluidic chip with three inlets, so as to demonstrate the flexibility of the gravitational sedimentation-based approach of the present invention. NB-4 cells stained with CFDA-SE green fluorescent dye and suspended in RPMI 1640 medium were used for this experiment. The NB-4 cells were first patterned using the microfluidic chip with three inlets. Meanwhile, the cell patterns under different tubing configurations were predicted through CFD simulation, which are visualized with streamlines (802, 804, and 806).

Figure 8A:
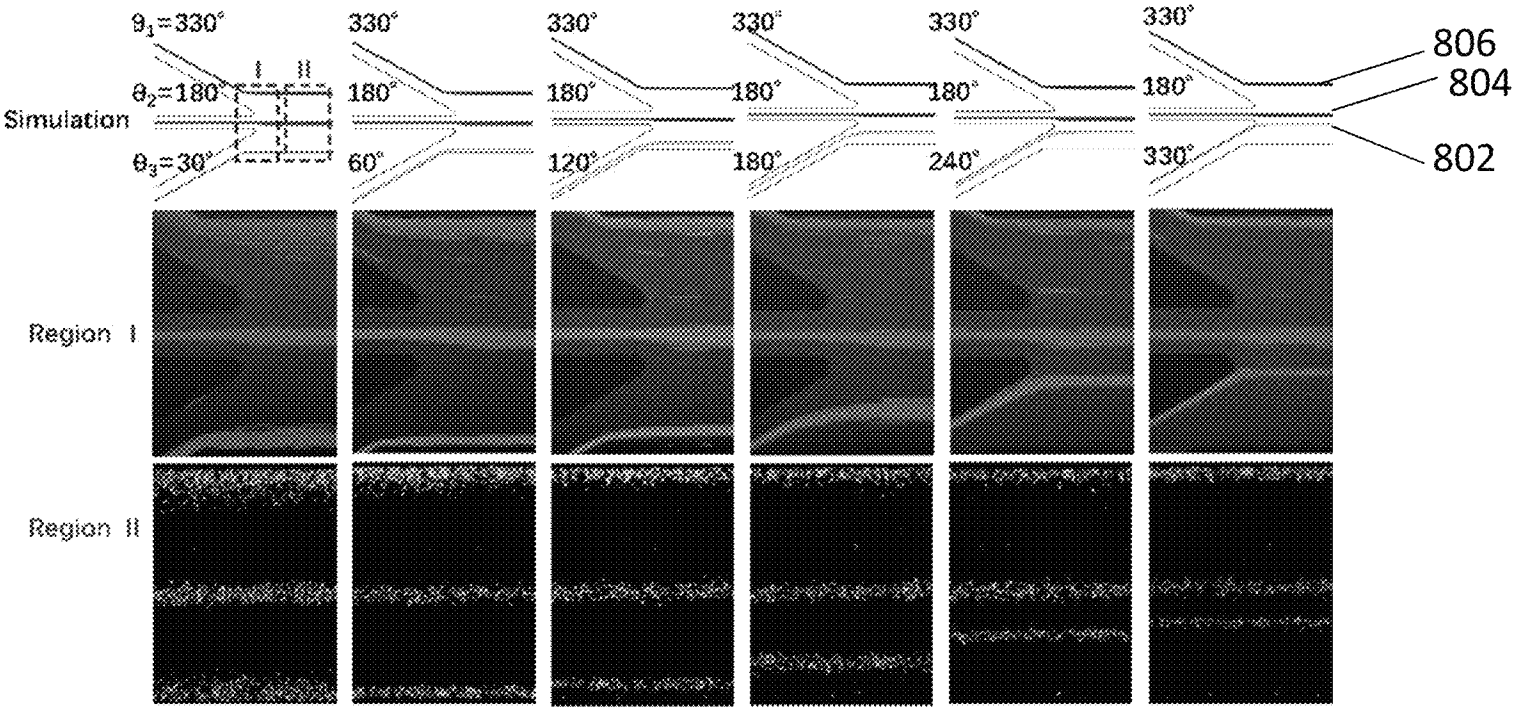
FIG. 8A is a series of microscopic images and their corresponding stimulations showing the cell patterning is adjustable by tuning the tubing steering angles.

As shown in FIG. 8A, three parallel cell strips were patterned on different microchannel positions, and the cell patterns were the same as the patterns predicted by CFD simulation. The cell strip 802, representing the cells loaded from the lower inlet, moved upward and became closer to the middle cell strip 804 when $\theta_3$ increased from 30° to 330°. This result clearly demonstrates that cell patterns can be flexibly adjusted by simply changing tubing directions, thereby eliminating the inconvenience for redesigning and fabricating new microfluidic chips. Whilst in this example only $\theta_3$ was changed, it is appreciated that the two other tubing steering angles $\theta_1$ and $\theta_2$ may also be changed to achieve different cell patterns for specific applications.

Figure 8B:
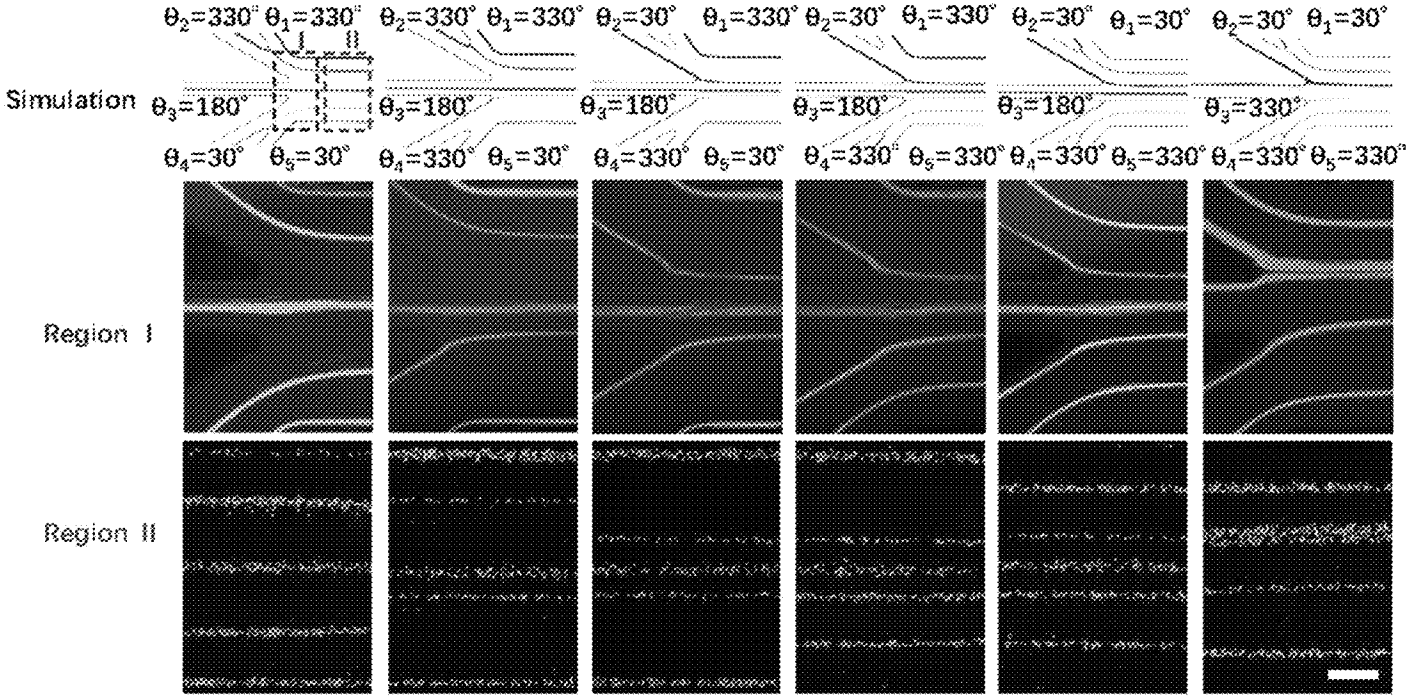
FIG. 8B is a series of microscopic images and their corresponding stimulations showing an alternative embodiment that the cell patterning is adjustable by tuning the tubing steering angles.

The NB-4 cells were then patterned using the microfluidic chip with five inlets. Similarly, the cell patterns under different tubing configurations were predicted through CFD simulation. As shown in FIG. 8B, the position of each cell strip may be adjusted by changing the corresponding tubing steering angles, which is similar to the cell patterning using the microfluidic chip with three inlets. It is manifest and advantageous that the increase in the number of inlets does not complicate the flow control of the microfluidic chip as compared with, for example, sheath flow-based approach. In addition, the simple adjusting method for cell patterns facilitate many other studies, such as constructing cell strips with different gap distances for studying short and long distance cell-cell communication in the same microenvironment at the same time.

The effect of flow rate as well as cell concentration on the cell patterning was investigated. In this example, the microfluidic chip with three inlets was used. NB-4 cells stained with green fluorescence were loaded into the microfluidic chip through a tubing inserted into the central inlet and the other two inlets were blocked. The tubing used herein has a length of 60 mm and the concentration of the NB-4 cells was set as 106 cells/mL.

Figure 9A:
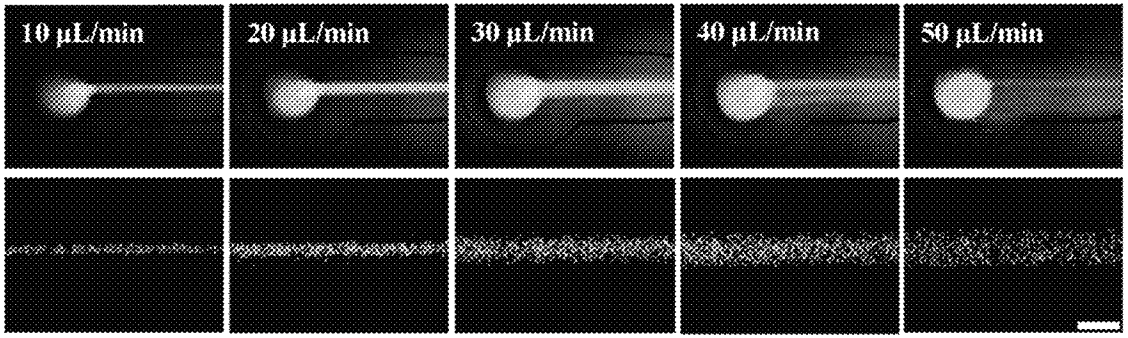
FIG. 9A is a series of microscopic images showing the effect of flow rates on the cell patterning.

As shown in FIG. 9A, the width of the cell strip broadened when the flow rate increased from 10 μL/min to 50 μL/min, implying that the cells could not completely sediment to the bottom of the tubing before they flow into the microchannel. The cells distributed in the microchannel were almost uniform when the flow rate reached 50 μL/min, indicating that the 60 mm tubing was not long enough to achieve cell focusing at such a high flow rate. It is appreciated that the cell focusing may be improved at a high flow rate by simply using a longer tubing.

Figure 9B:
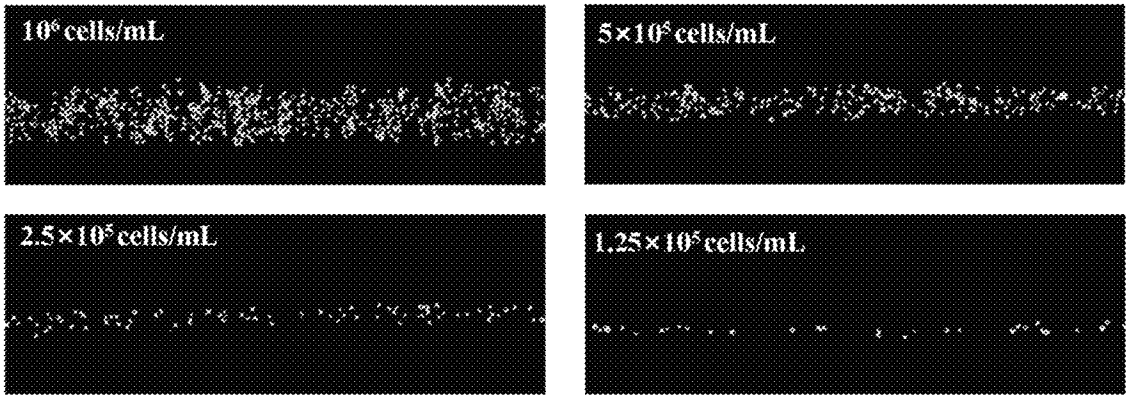
FIG. 9B is a series of microscopic images showing the effect of cell concentrations on the cell patterning.
Figure 10A:
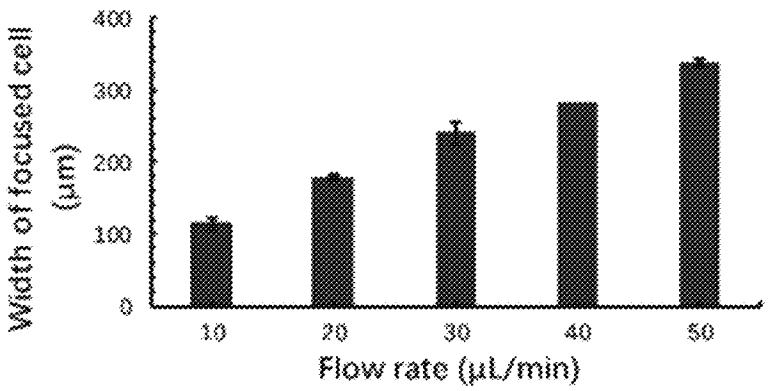
FIG. 10A is a plot of width of focused cell against flow rate quantitatively showing the relationship between the cell patterning and the flow rates of FIG. 9A.
Figure 10B:
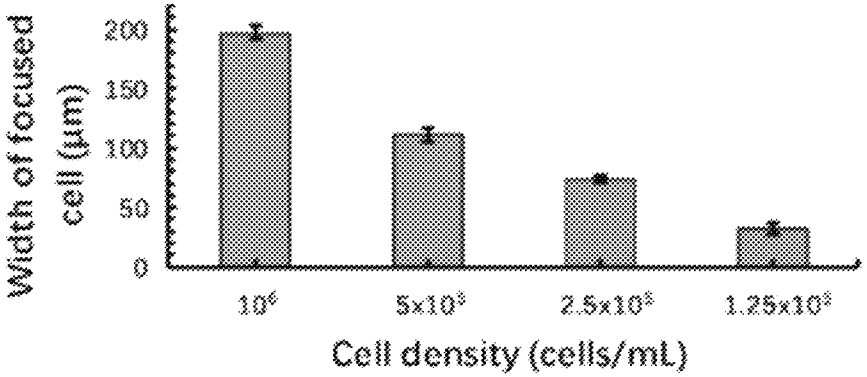
FIG. 10B is a plot of width of focused cell against flow rate quantitatively showing the relationship between the cell patterning and the cell concentrations of FIG. 9B.

Given the cell focusing performance in the flow rate experiment, the flow rate of 20 μL/min was selected for the cell patterning experiment under different cell concentrations. As shown in FIG. 9B, the width of NB-4 cell strip decreased with the cell concentrations. The influence of flow rate and cell concentration on the width of patterned cell strip was further characterized quantitatively and the results are shown in FIGS. 10A and 10B. All the results above (FIGS. 9 and 10) illustrate that the width of all the cell strips could be simultaneously adjusted by changing the flow rate, and the width of an individual cell strip could be selectively adjusted by changing the corresponding cell concentration, further demonstrating the flexibility of the present invention.

Figure 11:
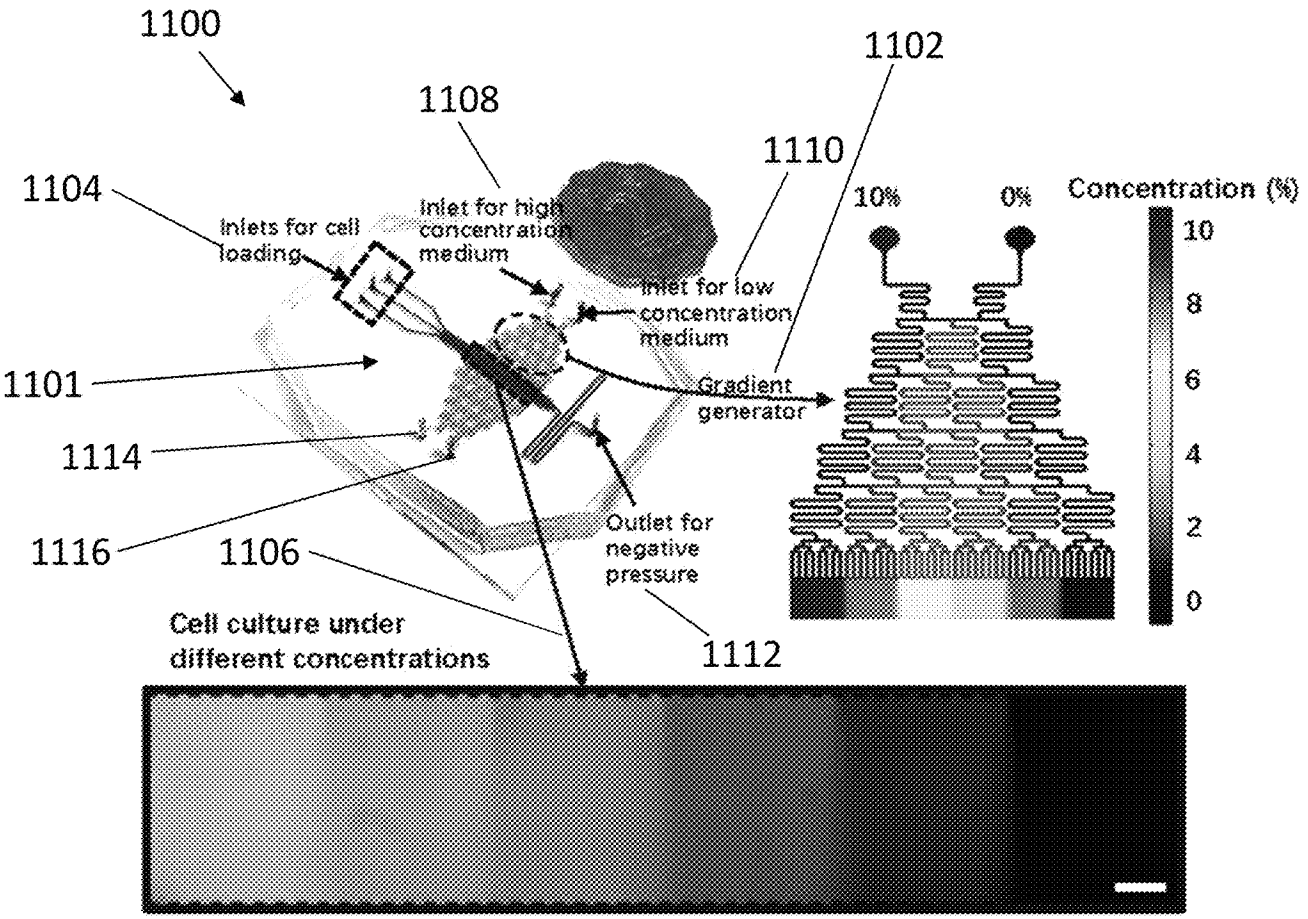
FIG. 11 is a photograph showing the apparatus of the present invention implemented as a cell patterning coculture chip integrated with a gradient generator. The right enlarged image is a schematic illustration showing a stimulation of concentration distribution of the gradient generator. The bottom enlarged image is an optical image showing a FITC gradient generated by the gradient generator in the cell patterning coculture region of the chip, scale bar=500 μm.

To demonstrate that the present invention is easy to integrate with other microfluidic functionalities, an apparatus 1100 was fabricated, with a "Christmas tree" shaped gradient generator 1102 was integrated with a cell patterning microfluidic chip 1101 with three inlets 1104 (FIG. 11). The gradient generation of the gradient generator 1102 was first investigated by simulation experiment. Referring to FIG. 11, six concentrations, 10%, 8%, 6%, 4%, 2%, and 0%, were generated in six different sections of the cell coculture channel 1106 when two kinds of media with concentrations of 10% and 0% were supplied through the two gradient generator inlets (1108, 1110).

Fluorescein isothiocyanate (FITC)-dextran (10 μM, MW 10000), whose molecular weight is similar to some drugs, such as growth factor (GF) or FBS, was used to experimentally confirm that the gradient generator 1102 is operable with the fabricated microfluidic chip 1101. Two solutions, with and without FITC-dextran, were simultaneously injected into the inlets (1108, 1110) of the gradient generator 1102 by using two syringe pumps at the same flow rate. For the gradient generation test, inlets (1104) and outlets (1112) for cell patterning were plugged, and the two inlets (1114, 1116) of the other gradient generator were opened to allow fluid to flow out.

As shown in FIG. 11, six FITC-dextran concentrations were established in the cell patterning coculture region 1106, and the distribution of the generated FITC-dextran gradient matches well with the simulation results. The flow direction during FITC-dextran solution perfusion was perpendicular to the flow direction for cell patterning, indicating that the gradient was parallel to the patterned cell strips. The integration of gradient generation with the gravitational sedimentation-based cell patterning could facilitate the investigation of responses of different cellular behaviors to different bio/chemical stimulations under patterning coculture condition.

To investigate the ability of the present invention for coculturing the patterned cells under a cell medium concentration gradient as discussed above, as well as to demonstrate the potential application of the present invention for high-throughput drug screening, patterned Hela-GFP cells were cocultured under a FBS gradient using the integrated microfluidic chip 1100. A syringe pump, which was connected to the outlet of the chip, was set to aspirate cells into the chip during the cell patterning process. During the cell patterning process, the tubings for gradient generation were blocked (i.e. the inlets 1108, 1110, 1114, 1116 were blocked). The three steering angles of the three tubings for cell loading were configured to be 330°, 180°, and 30°.

Figure 12:
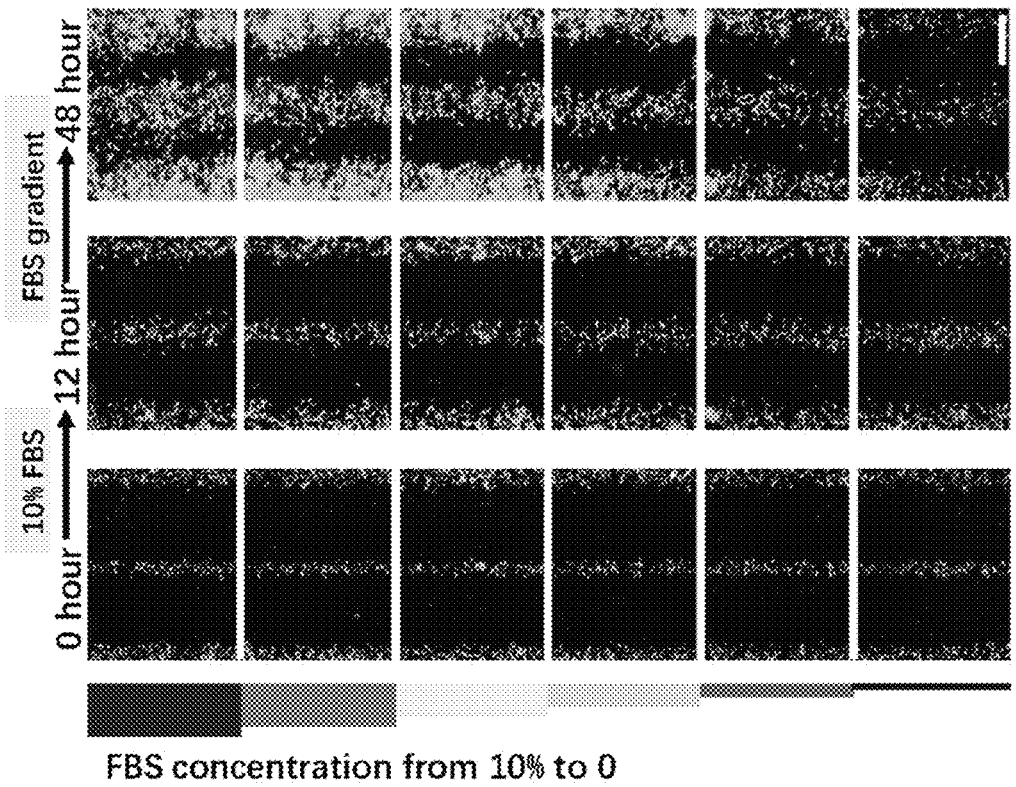
FIG. 12 is a series of microscopic images showing the patterning coculture of Hela-GFP cells under different FBS concentrations.

As shown in FIGS. 11 and 12, Hela-GFP cells were patterned to be three cell strips located at the left side, the middle part, and the right side of the microchannel. After 12 h of settling down and attachment by using 10% DMEM, the medium with 10% FBS and a serum-free medium were injected into the inlets of one gradient generator (e.g. inlets 1108 and 1110) at a flow rate of 0.25 μL/min, and allowed to flow out from the inlets of the other gradient generator (e.g. inlets 1114 and 1116) to generate a FBS gradient in the microchannel 1106 with the patterned Hela-GFP cells.

Figure 13A:
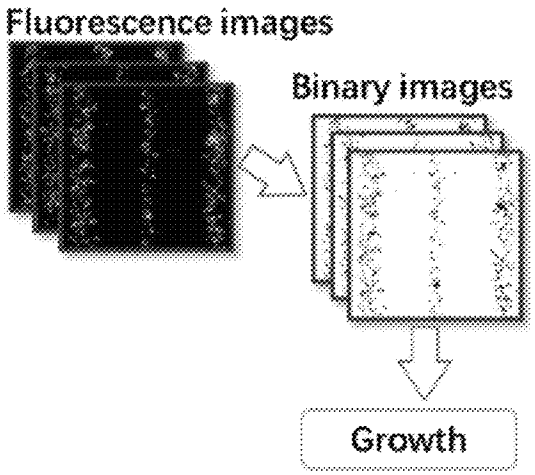
FIG. 13A is a schematic illustration showing the analysis of the growth of the patterned cells based on image processing.

As shown in FIG. 12, the gaps between two adjacent cell strips showed a similar decrease in different patterning sections when the cells were cocultured for 12 h without FBS gradient. In contrast, the gaps for different patterning sections, which were cocultured under different FBS concentrations in the following 36 h, decreased differently. In order to quantitatively characterize the influence of FBS gradient on the growth of Hela-GFP cells, the fluorescence images as shown in FIG. 12 were processed as shown in FIG. 13A. Briefly, the fluorescence images were first converted into binary images to distinguish between cells and background. The growth of the patterned cells at different times was then analyzed on the basis of the gray value distribution of the binary images.

Figure 13B:
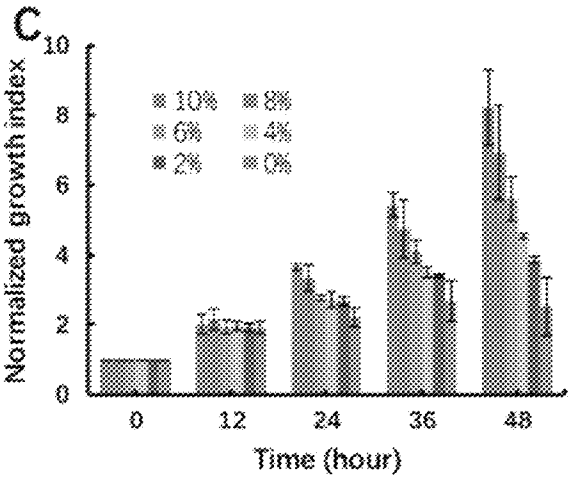
FIG. 13B is a plot of normalized growth index against showing the relationship between the growth of the Hela-GFP cells and different FBS concentrations.

As shown in FIG. 13B, the normalized growth index of the patterned Hela-GFP cells at different FBS concentrations and times indicates that all sections of the patterned cells grew with similar growth rate before 12 h. In contrast, after 12 h, from which the cells were exposed to the FBS concentration gradient, Hela-GFP cells exposed in a higher FBS concentration grew faster than the cells exposed in a lower FBS concentration; and the cells exposed in 0% FBS concentration grew particularly slow under the same experimental conditions. This result suggests that the cells were capable to grow according to the nutrition provided by the FBS concentration gradient.

The results discussed also demonstrated that the integrated microfluidic chip 1100 is capable of coculturing patterned cells under a drug gradient. The gravitational sedimentation-based cell patterning coculture approach of the present invention was absolutely biocompatible and non-destructive to cells as there is no necessity to apply external forces, such as DEP force and optical trap. By using this approach, more precise drug screening may be easily achieved.

The feasibility of using the present invention for cancer cells-normal stromal cells interaction research was investigated. In this example, Hela-GFP cells and a mixture of human umbilical vein cell line (EA.hy926) and normal human dermal fibroblasts (HDFn) were patterned and cocultured under the FBS concentration gradient using the apparatus 1100. The tubing steering angles were configured at 30°, 180°, and 330°, and the inlets of the gradient generator were blocked during the cell patterning process.

As shown in FIG. 14A, Hela-GFP cells were patterned into two cell strips, (i.e. the left cell strip 1402 and the middle cell strip 1404). The mixture of EA.hy 926 and HDFn cells was patterned into the right cell strip 1406. DMEM supplemented with 10% FBS was introduced from the gradient generator inlets 1108, 1110, which are located beside the mixed cells, and flow out from the inlets 1114, 1116 of the other gradient generator at a flow rate of 0.25 μL/min. The bright and fluorescence images of the cells were captured from 0 h to 48 h with a 12 h step time to record cell proliferation.

Figure 14:
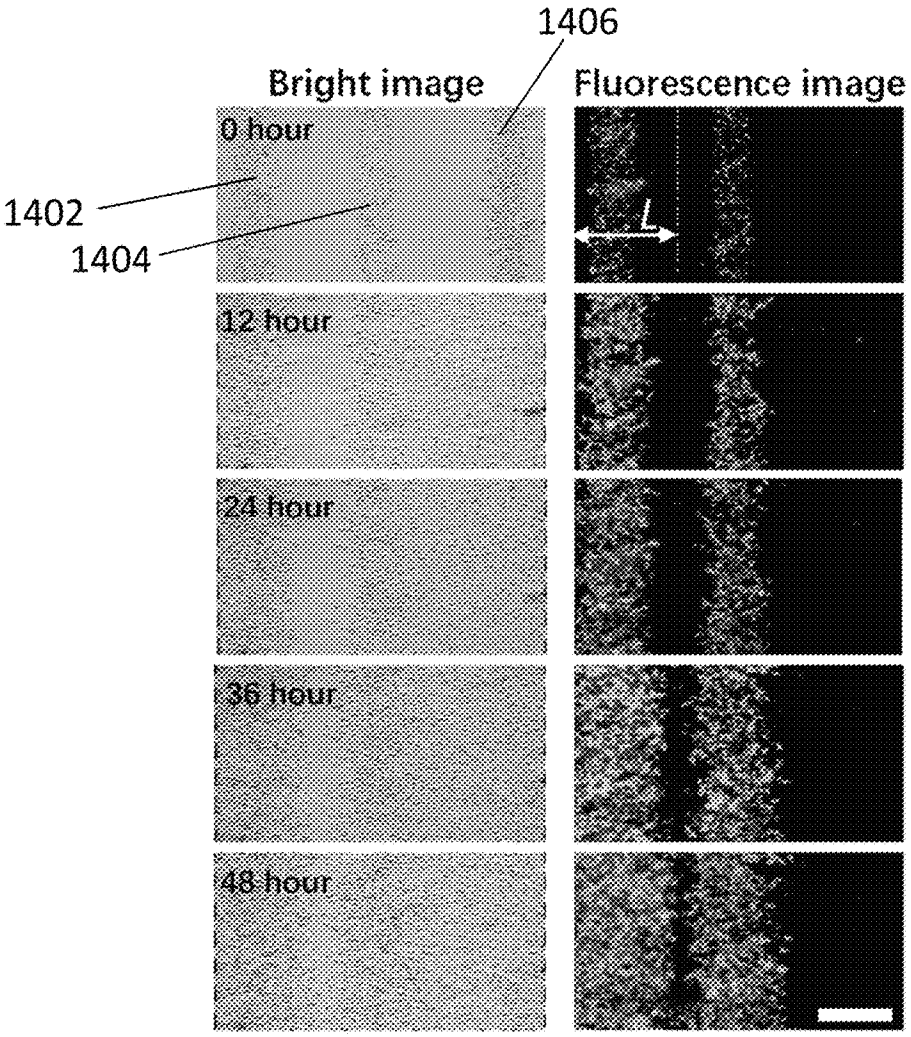
FIG. 14 is a series of microscopic images showing the patterning coculture of Hela-GFP cells and a mixture of HDFn+Ea.hy962 cells from 0 h to 48 h.
Figure 15A:
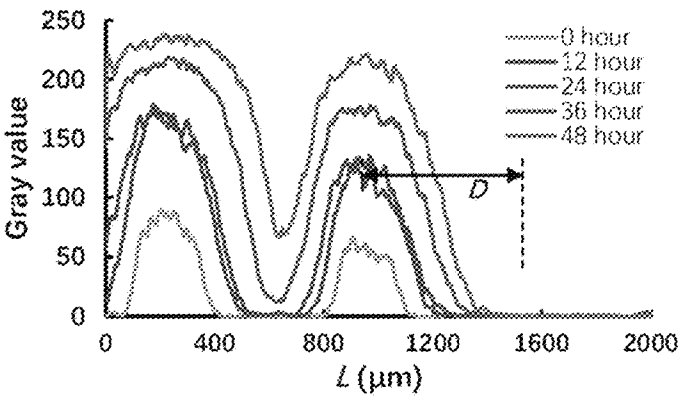
FIG. 15A is a plot showing distribution of the Hela-GFP cells represented by the fluorescence profiles at different times.

As shown in FIG. 14, all the cells adhered to the bottom surface of the microchannel at 0 h and grew at different rates after 12 h. In particular, the mixed cells 1406 grew and occupied most of the space in the right gap after 12 h of coculture. The central Hela-GFP cells 1404 tended to migrate to the side of the mixed cells, which could be seen in the fluorescent photographs of FIG. 14. The oriented migration of the central Hela-GFP cells might be induced by the secreted GF of HDFn and EA.hy 926 cells. This phenomenon was quantitatively analyzed on the basis of the fluorescent distribution profiles and the results are shown in FIG. 15A.

Figure 15B:
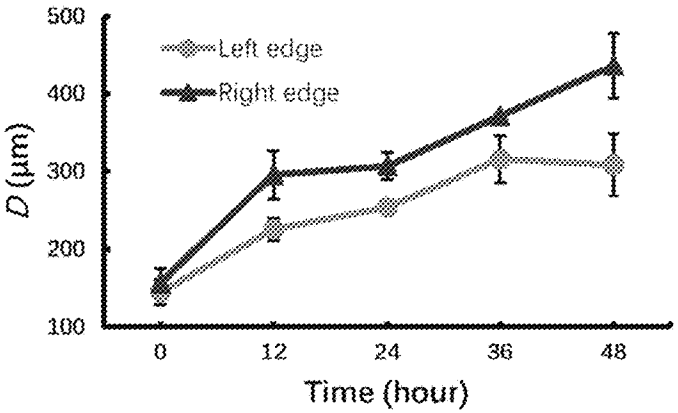
FIG. 15B is a plot D value against showing the relationship between the D values of FIG. 15A and different times.

The distances away from the right and left edges of the middle Hela-GFP cell strip 1404 at different times to the central position of the middle Hela-GFP cell strip at 0 h are illustrated in FIG. 15B. The positions of the right edge of the central Hela-GFP cell strip at different times were retrieved from the data in FIG. 15A by selecting the first position whose gray value is less than 1. The left edges of the middle Hela-GFP cell strip at 0, 12, and 24 h were also retrieved from the data in FIG. 15A by using the threshold of 1 for the gray value. The boundaries of the left and central Hela-GFP cell strips were indistinct after 36 h of coculture. Hence, the left edges of the middle Hela-GFP cell strip at 36 and 48 h were defined to be the position of the troughs.

As shown in FIG. 15B, the cells from the middle Hela-GFP cell strips migrated farther to the right than to the left, demonstrating the oriented migration of Hela-GFP cells to endothelial cells and fibroblasts under the coculture condition established by using the cell patterning approach disclosed herein. The patterning coculture of multiple cell types could also be conducted under gradient generation. All the above results again demonstrated that the present invention features great simplicity and flexibility for the construction of cell coculture models for various applications, such as drug screening and studying cell-cell interactions.

The apparatus of the present invention is advantageous since it allows multiple cell types with great difference on cell size to be patterned in the same microfluidic channel without using sheath flows or prepatterned functional surfaces, thereby simplifying chip fabrication and hardware setup. In addition, the spatial arrangement of each type of cells can be easily adjusted by simply altering the tubing steering angles, therefore the cell pattern may be readily modified for fitting different applications without the need of redesigning the chip or applying any complex hardware setup.

Moreover, by using the presently claimed apparatus, multiple types of cell can be introduced simultaneously into the chip via the multiple inlets and subsequently be patterned. That is to say, the whole process is a one-step operation. Furthermore, the patterning and coculturing with the use of the presently claimed apparatus is more biocompatible and can be easily integrated with other functional modules.

The description of any of these alternative embodiments is considered exemplary. Any of the alternative embodiments and features in the alternative embodiments can be used in combination with each other or with the embodiments described with respect to the figures.

The foregoing describes only a preferred embodiment of the present invention and modifications, obvious to those skilled in the art, can be made thereto without departing from the scope of the present invention. While the invention has been described with reference to a number of preferred embodiments it should be appreciated that the invention can be embodied in many other forms.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A method of patterning and coculturing biological cells, the method comprising steps of:

providing an apparatus, the apparatus comprising a fluidic structure having an outlet and a plurality of inlets, the fluidic structure being arranged to facilitate a flow of a plurality of different cells in a cell suspension therethrough, wherein each of the plurality of inlets is arranged to facilitate a loading of the plurality of different cells from a plurality of supplies into the fluidic structure; and a flow controlling device arranged to control the flow of the plurality of different cells through the fluidic structure and/or the loading of the plurality of different cells from the plurality of supplies through the plurality of inlets;

wherein the fluidic structure is further arranged to facilitate a simultaneous observation of the plurality of different cells arranged in a predetermined pattern in the fluidic structure;

loading the fluidic structure of the apparatus with the plurality of different cells in the cell suspension, by connecting the plurality of supplies to the plurality of inlets;

manipulating a pressure at the outlet of the fluidic structure so as to control the flow of the plurality of different cells along the fluidic structure; and suspending the flow of the plurality of different cells so as to initiate cell coculturing thereof within the fluidic structure.

2. The method according to claim 1, further comprising steps of:

incubating the plurality of different cells within the fluidic structure under a predetermined condition;

supplying the plurality of different cells within the fluidic structure with a cell medium solution of different concentrations through a gradient generator, so as to generate a cell concentration gradient across a predetermined length of the fluidic structure.

3. The method according to claim 2, wherein the cell medium solution is supplied at a flow rate of 0.25 μL/min.

4. The method according to claim 1, further comprising a step of:

purging the fluidic structure to remove air bubbles therein.

5. The method according to claim 1, wherein the predetermined pattern includes a laminar flow pattern of the plurality of different cells.

6. The method according to claim 5, wherein each of the plurality of different cells are visually separable from each other.

7. The method according to claim 1, wherein the flow controlling device is arranged to provide a negative pressure to the fluidic structure so as to drive the plurality of different cells to flow through the fluidic structure and/or to control the loading of the plurality of different cells from the plurality of supplies through the plurality of inlets.

8. The method according to claim 7, wherein the flow controlling device includes a negative pressure pump arranged to connect to the outlet of the fluidic structure, and arranged to draw air therefrom.

9. The method according to claim 8, wherein the negative pressure pump connects to a syringe that is in fluidic communication with the outlet of the fluidic structure, and wherein the syringe is arranged to provide a reference for flow rate of the plurality of different cells flowing through the fluidic structure.

10. The method according to claim 1, wherein the outlet is configured in a serpentine shape arranged to further facilitate the control of the flow of the plurality of different cells.

11. The method according to claim 1, wherein each of the plurality of supplies includes a single type of cells or a mixture types of cells.

12. The method according to claim 1, wherein the fluidic structure includes a fluidic channel arranged to facilitate the plurality of different cells in the cell suspension to be arranged in the predetermined pattern.

13. The method according to claim 12, wherein the fluidic channel is further arranged to facilitate coculturing of the plurality of different cells in the cell suspension.

14. The method according to claim 12, wherein the fluidic channel includes a first region defined by the plurality of inlets, and wherein the first region is arranged to facilitate the plurality of different cells to flow along a laminar flow trajectory.

15. The method according to claim 14, wherein each of the plurality of inlets includes a tubular structure in fluidic communication thereto, and wherein the tubular structure is arranged to direct the plurality of different cells to enter into the first region at an angle with respect to a longitudinal axis of the first region.

16. The method according to claim 14, wherein the tubular structure is further arranged to facilitate sedimentation of the plurality of different cells across a predetermined length of the tubular structure, such that the plurality of different cells are arranged to form a focused cell stream along the tubular structure.

17. The method according to claim 13, further comprising at least one gradient generator in fluidic communication with the fluidic channel, wherein the gradient generator is arranged to facilitate a concentration gradient of the cells across a predetermined length of the fluidic channel.

18. The method according to claim 17, wherein the at least one gradient generator is perpendicular to the fluidic channel.

19. The method according to claim 17, wherein the gradient generator includes a dilution network of microfluidic channels configured in a tree shape.

20. The method according to claim 17, wherein the gradient generator further includes a pair of inlets and a plurality of quadruple mixing outlets in fluidic communication with the fluidic channel of the fluidic structure.

21. The method according to claim 12, wherein the fluidic channel is coated with fibronectin.

22. The method according to claim 1, wherein the fluidic structure includes a polydimethylsiloxane (PDMS) microfluidic chip.

23. The method according to claim 22, wherein the polydimethylsiloxane microfluidic chip is deposited on a glass substrate.

24. The method according to claim 1, further comprising an observation system arranged to record the plurality of different cells in the fluidic structure.

25. The method according to claim 15, wherein the tubular structure includes a polyethylene tubing.

* * * * *